US011420715B1

(12) United States Patent
Simard et al.

(10) Patent No.: US 11,420,715 B1
(45) Date of Patent: Aug. 23, 2022

(54) MULTIHULL WATERCRAFT

(71) Applicant: BOMBARDIER RECREATIONAL PRODUCTS INC., Valcourt (CA)

(72) Inventors: Richard Simard, Drummondville (CA); Simon Erpelding, Racine (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 141 days.

(21) Appl. No.: 17/038,662

(22) Filed: Sep. 30, 2020

Related U.S. Application Data

(60) Provisional application No. 62/908,514, filed on Sep. 30, 2019.

(51) Int. Cl.

| | |
|---|---|
| ***B63B 35/38*** | (2006.01) |
| ***B63B 3/48*** | (2006.01) |
| ***B63B 3/68*** | (2006.01) |
| ***B63B 1/12*** | (2006.01) |
| ***B63B 13/02*** | (2006.01) |
| ***B63B 5/00*** | (2006.01) |
| ***B63B 3/26*** | (2006.01) |

(52) U.S. Cl.
CPC ..... *B63B 35/38* (2013.01); *B63B 1/125* (2013.01); *B63B 3/26* (2013.01); *B63B 3/48* (2013.01); *B63B 3/68* (2013.01); *B63B 5/00* (2013.01); *B63B 13/02* (2013.01)

(58) Field of Classification Search
CPC ..... B63B 35/00; B63B 35/38; B63B 1/00; B63B 1/125; B63B 3/00; B63B 3/26; B63B 3/48; B63B 3/68; B63B 5/00; B63B 13/00; B63B 13/02
USPC ..... 114/61.2
See application file for complete search history.

(56) References Cited

U.S. PATENT DOCUMENTS

| | | | |
|---|---|---|---|
| 2,585,599 | A | 2/1952 | Tehetchet |
| 2,991,746 | A | 7/1961 | Cunningham |
| 3,316,873 | A | 5/1967 | Dismukes |
| 3,601,077 | A | 8/1971 | Valenza, Jr. |
| 3,661,108 | A | 5/1972 | Sorenson |
| 3,970,025 | A | 7/1976 | Sovia et al. |
| 4,924,797 | A | 5/1990 | Solia |
| 5,619,944 | A | 4/1997 | Baker |
| 5,676,087 | A | 10/1997 | Baker |
| 5,803,007 | A | 9/1998 | Stevens |
| 6,199,340 | B1 | 3/2001 | Davis |
| 6,345,581 | B2 | 2/2002 | Blanchard |
| 6,546,890 | B1 | 4/2003 | Craig |

(Continued)

*Primary Examiner* — Lars A Olson
(74) *Attorney, Agent, or Firm* — BCF LLP

(57) ABSTRACT

A watercraft includes: a central frame; a deck supported by the central frame; and first and second lateral hulls laterally spaced apart from one another, the central frame being disposed at least in part laterally between the first and second lateral hulls. Each of the lateral hulls includes: a plurality of lower hull panels mounted to the central frame, at least part of an outer surface of each lower hull panel forming a running surface of the watercraft; a plurality of braces connected between the central frame, the plurality of lower hull panels and the deck; and at least one buoyant element received in and substantially filling a space defined between the lower hull panels and the deck. Each brace includes: an inner mount connected to the central frame, a lower mount connected to at least one lower hull panel, and an upper mount connected to the deck.

20 Claims, 31 Drawing Sheets

(56) References Cited

U.S. PATENT DOCUMENTS

| | | | | |
|---|---|---|---|---|
| 6,564,735 | B1 * | 5/2003 | Jackson | B63B 35/36 114/61.1 |
| 6,988,456 | B1 | 1/2006 | Schooler | |
| 7,143,710 | B2 | 12/2006 | Lang et al. | |
| 7,185,599 | B1 | 3/2007 | Griffiths et al. | |
| 7,188,576 | B2 | 3/2007 | Bogard et al. | |
| 7,418,915 | B2 | 9/2008 | Campbell | |
| 7,533,622 | B1 | 5/2009 | Jaszewski et al. | |
| 8,186,291 | B1 | 5/2012 | Curtis | |
| 8,833,284 | B1 | 9/2014 | Resta | |
| 9,038,561 | B2 | 5/2015 | Loui et al. | |
| 9,108,710 | B1 | 8/2015 | Broughton et al. | |
| 9,114,853 | B1 | 8/2015 | Apple et al. | |
| 9,475,548 | B1 | 10/2016 | Slocum | |
| 9,517,824 | B1 | 12/2016 | Erpelding et al. | |
| 2003/0154896 | A1 | 8/2003 | Schmidt | |
| 2004/0168623 | A1 | 9/2004 | Kirk | |
| 2005/0126464 | A1 | 6/2005 | Lang et al. | |
| 2007/0039534 | A1 | 2/2007 | Reilly et al. | |
| 2007/0039535 | A1 | 2/2007 | Reilly et al. | |
| 2007/0056496 | A1 | 3/2007 | Hodgson | |
| 2009/0227159 | A1 | 9/2009 | Meyer | |
| 2012/0024211 | A1 | 2/2012 | Wiltse | |
| 2012/0164896 | A1 | 6/2012 | Kobayashi et al. | |

* cited by examiner

MULTIHULL WATERCRAFT

CROSS-REFERENCE

The present application claims priority from U.S. Provisional Patent Application No. 62/908,514, filed on Sep. 30, 2019, the entirety of which is incorporated herein by reference.

FIELD OF TECHNOLOGY

The present technology relates to multihull watercraft.

BACKGROUND

Some recreational watercraft such as pontoon boats include two or more hulls that provide buoyancy and stability thereto and that are interconnected by a frame or a third central hull. The hulls of a pontoon boat (also called pontoons) can be made in a variety of ways including for example from welded sheets of aluminum, steel or other metallic materials, or in other cases from molded plastic. In some cases, a single-piece multihull component can be made from molded fiberglass.

However, these manufacturing methods can be labor intensive and thus expensive to implement. Furthermore, different sized hulls have to be used for pontoon boats of different sizes which can be expensive for the manufacturer as additional tooling and/or significant amount of labor can be required to provide such a variety of hulls. Additionally, there is a logistical problem posed by having significant quantities of different sized hulls on hand to be able to offer the pontoon boats of different sizes.

In view of the foregoing, there is a need for a multihull watercraft that addresses at least some of these drawbacks.

SUMMARY

It is an object of the present technology to ameliorate at least some of the inconveniences present in the prior art.

According to an aspect of the present technology, there is provided a watercraft, including: a central frame; a deck extending at least partially above and supported by the central frame; first and second lateral hulls laterally spaced apart from one another, the central frame being disposed at least in part laterally between the first and second lateral hulls. Each of the first and second lateral hulls includes: a plurality of lower hull panels mounted to the central frame, at least part of an outer surface of each lower hull panel of the plurality of lower hull panels forming a running surface of the watercraft; a plurality of braces connected between the central frame, the plurality of lower hull panels and the deck, each brace of the plurality of braces comprising: an inner mount connected to the central frame; a lower mount connected to at least one lower hull panel of the plurality of lower hull panels; and an upper mount connected to the deck; and at least one buoyant element received in and substantially filling a space defined between the plurality of lower hull panels and the deck.

In some embodiments, each of the first and second lateral hulls further includes: a plurality of side panels extending between an outer lateral edge of at least one lower hull panel of the plurality of lower hull panels and an outer lateral edge of the deck.

In some embodiments, the deck includes a plurality of tiles, at least some of the plurality of tiles being connected along an inner edge thereof to the central frame and along an outer edge thereof to at least one brace of the plurality of braces.

In some embodiments, the central frame includes a central hull.

In some embodiments, the deck has an upper surface; and the watercraft further includes a central hull cover connected to the central hull and having an upper surface that is contiguous with the upper surface of the deck.

In some embodiments, the watercraft further includes a power pack disposed at least partially between the central hull and the central hull cover.

In some embodiments, each lower hull panel of the plurality of lower hull panels has an interlocking portion adjacent to an inner edge thereof for interlocking with a complementary portion of the central hull cover.

In some embodiments, for each of the first and second lateral hulls: each of the at least one buoyant element has an upper surface; and a gap is defined between the upper surface of each of the at least one buoyant element and the deck.

In some embodiments, wiring extends through the gap defined between the upper surface of each of the at least one buoyant element and the deck.

In some embodiments, each of the plurality of braces includes a plurality of beam portions extending substantially linearly, including: a first beam portion extending between the upper mount and the lower mount; a second beam portion extending between the inner mount and the upper mount; and a third beam portion extending between the inner mount and the first beam portion.

In some embodiments, the third beam portion extends between the inner mount and the lower mount.

In some embodiments, for each of the first and second lateral hulls: the inner mount of each brace of the plurality of braces is positioned vertically between the upper mount and the lower mount thereof.

In some embodiments, for each of the first and second lateral hulls: the inner mount of each brace of the plurality of braces is connected to the central frame; and a corresponding lower hull panel of the plurality of lower hull panels is mounted to the inner mount.

In some embodiments, an interior of each of the first and second lateral hulls is in fluid communication with an exterior thereof such that water can flow into and out of the first and second lateral hulls.

In some embodiments, for each of the first and second lateral hulls, adjacent lower hull panels of the plurality of lower hull panels are fastened to one another via fasteners.

In some embodiments, each lower hull panel of the plurality of lower hull panels is a molded component.

In some embodiments, for each of the first and second lateral hulls, consecutive lower hull panels of the plurality of lower hull panels are longitudinally adjacent to one another.

In some embodiments, each of the first and second lateral hulls has a same number of lower hull panels such that a length of the first lateral hull is the same as a length of the second lateral hull.

In some embodiments, for each of the first and second lateral hulls: the at least one buoyant element defines a plurality of recesses, each recess of the plurality of recesses being configured to receive in part a respective brace of the plurality of braces.

In some embodiments, the at least one buoyant element is at least one foam block.

In some embodiments for each of the first and second lateral hulls, the lower hull panels of the plurality of hull panels form a chine.

Embodiments of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
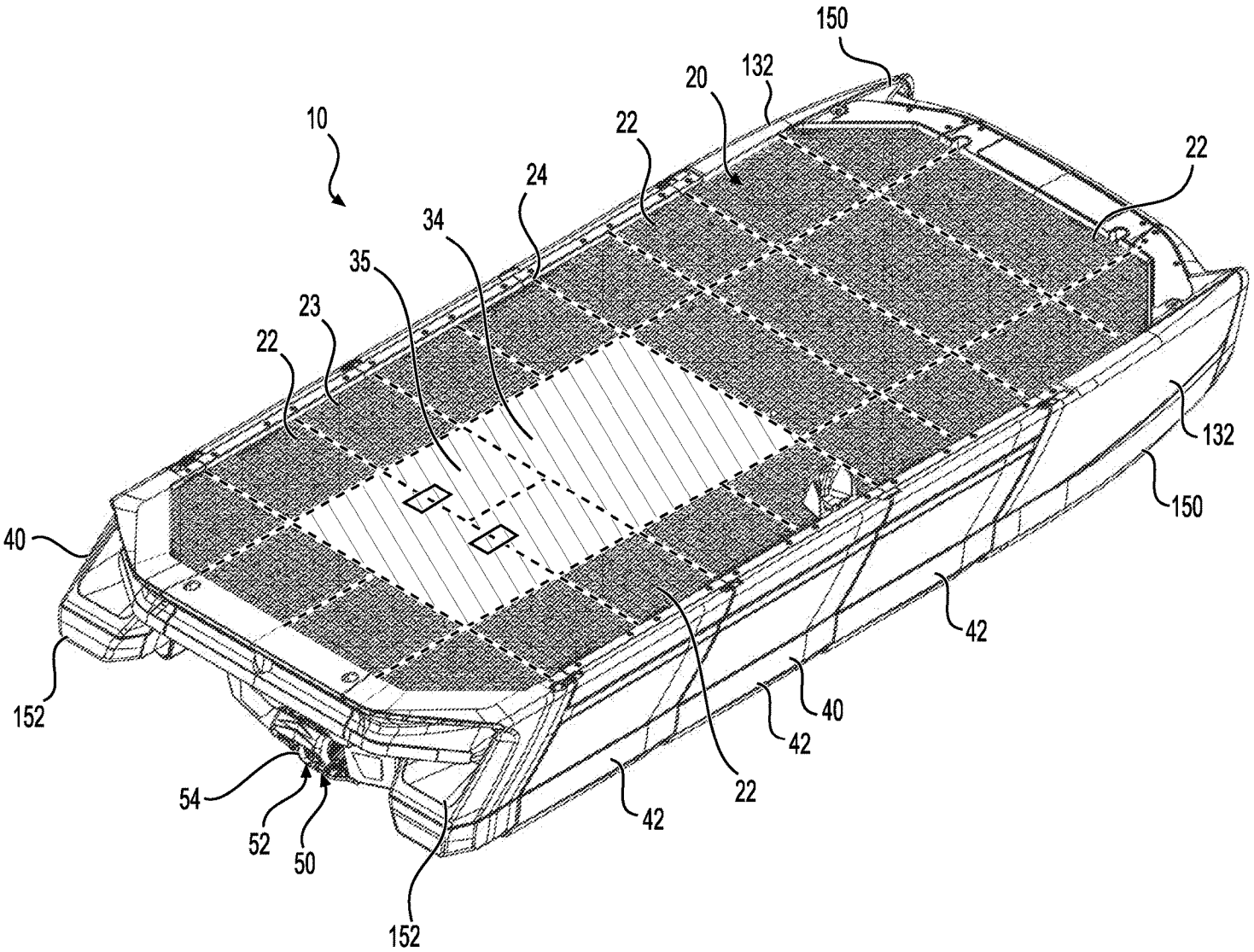
FIG. 1 is a perspective view, taken from a top rear right side, of a pontoon boat in accordance with an embodiment of the present technology.
Figure 2:
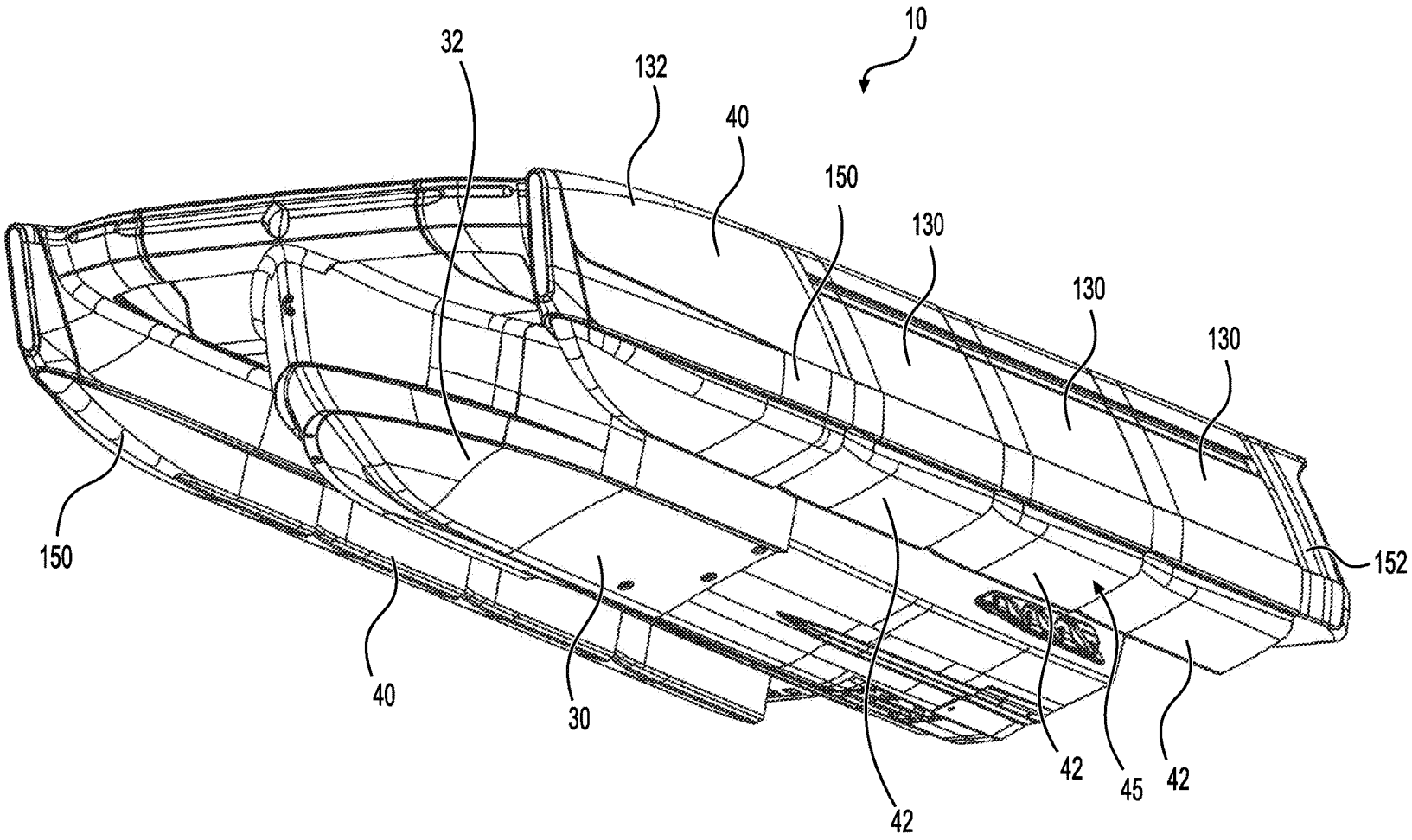
FIG. 2 is a perspective view, taken from a bottom front left side, of the pontoon boat of FIG. 1.
Figure 3:
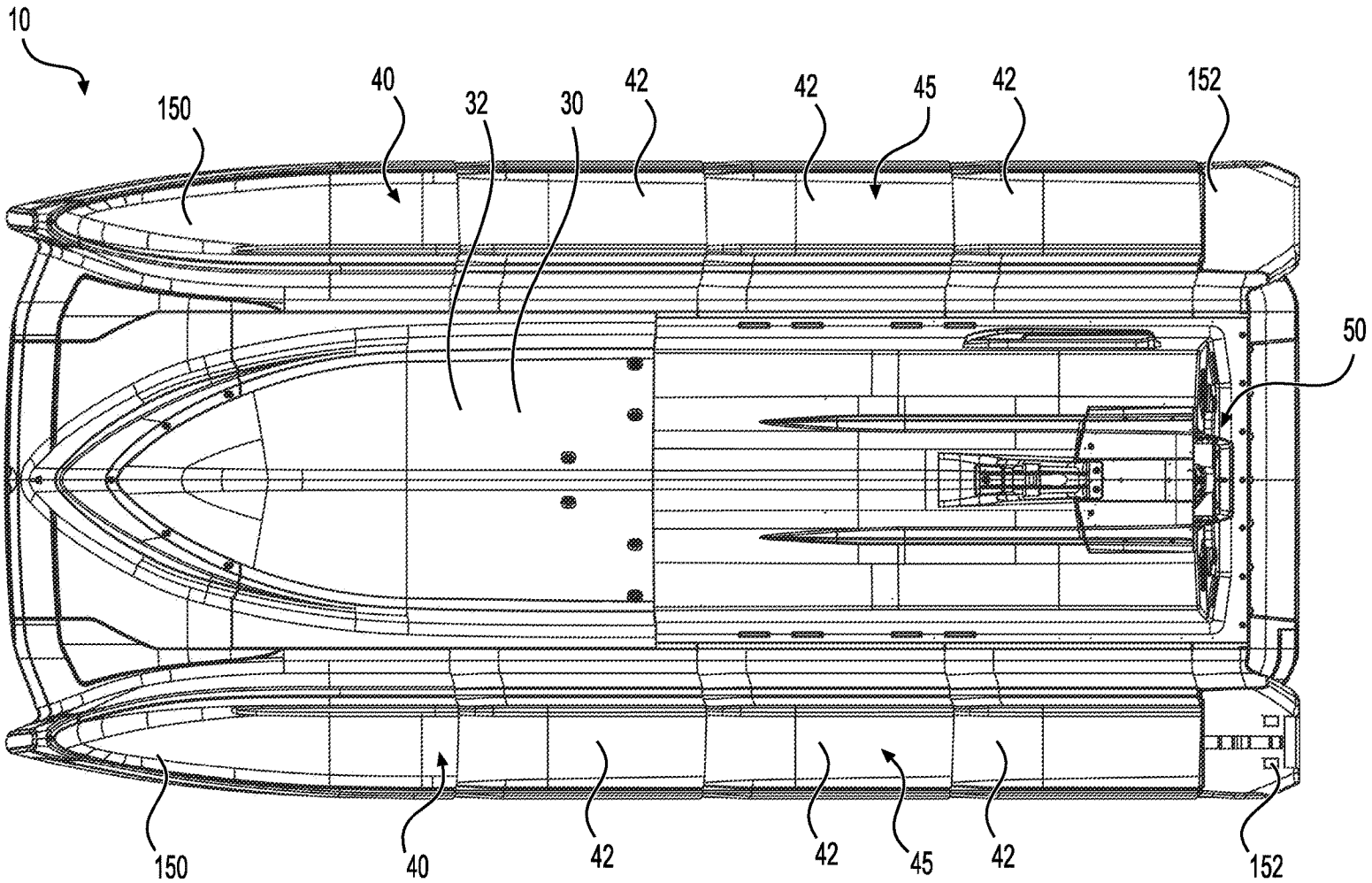
FIG. 3 is a bottom plan view of the pontoon boat of FIG. 1.

A watercraft 10 in accordance with one embodiment of the present technology is shown in FIGS. 1 to 5. The following description relates to one example of a watercraft 10, notably a pontoon boat 10. Those of ordinary skill in the art will recognize that there are other known types of watercrafts incorporating different designs and that the present technology would encompass these other watercrafts.

The boat 10 is a multihull watercraft, notably having a central hull 32, a left hull 40 and a right hull 40. The left and right hulls 40 are laterally spaced apart from one another and are separated by a central frame 30 that is laterally centered therebetween and to which both the left and right hulls 40 are connected as will be described in greater detail below. As can be seen, in this embodiment, the central frame 30 includes the central hull 32. As such, in this embodiment, the boat 10 has three separate hulls. It is contemplated that, in other embodiments, the central frame 30 may not have the central hull 32 and may instead simply include a rigid structure connected between the left and right hulls 40. Thus, the boat 10 may only have two hulls in other embodiments.

A deck 20 extends above the left hull 40, the right hull 40 and the central hull 32 and is supported thereby. The deck 20 has an upper surface 24 for supporting occupants, as well as accessories and accommodations of the boat 10 (e.g., seating, command console, etc.). In this embodiment, as best seen in FIG. 1, the deck 20 includes a plurality of tiles 22 which are configured for attachment of accessories thereto. The tiles 22 form a portion of the upper surface 24 of the deck 20. Notably, a number of the tiles 22 extend over the left hull 40, some over the right hull 40 and some others over the central hull 32.

Figure 14:
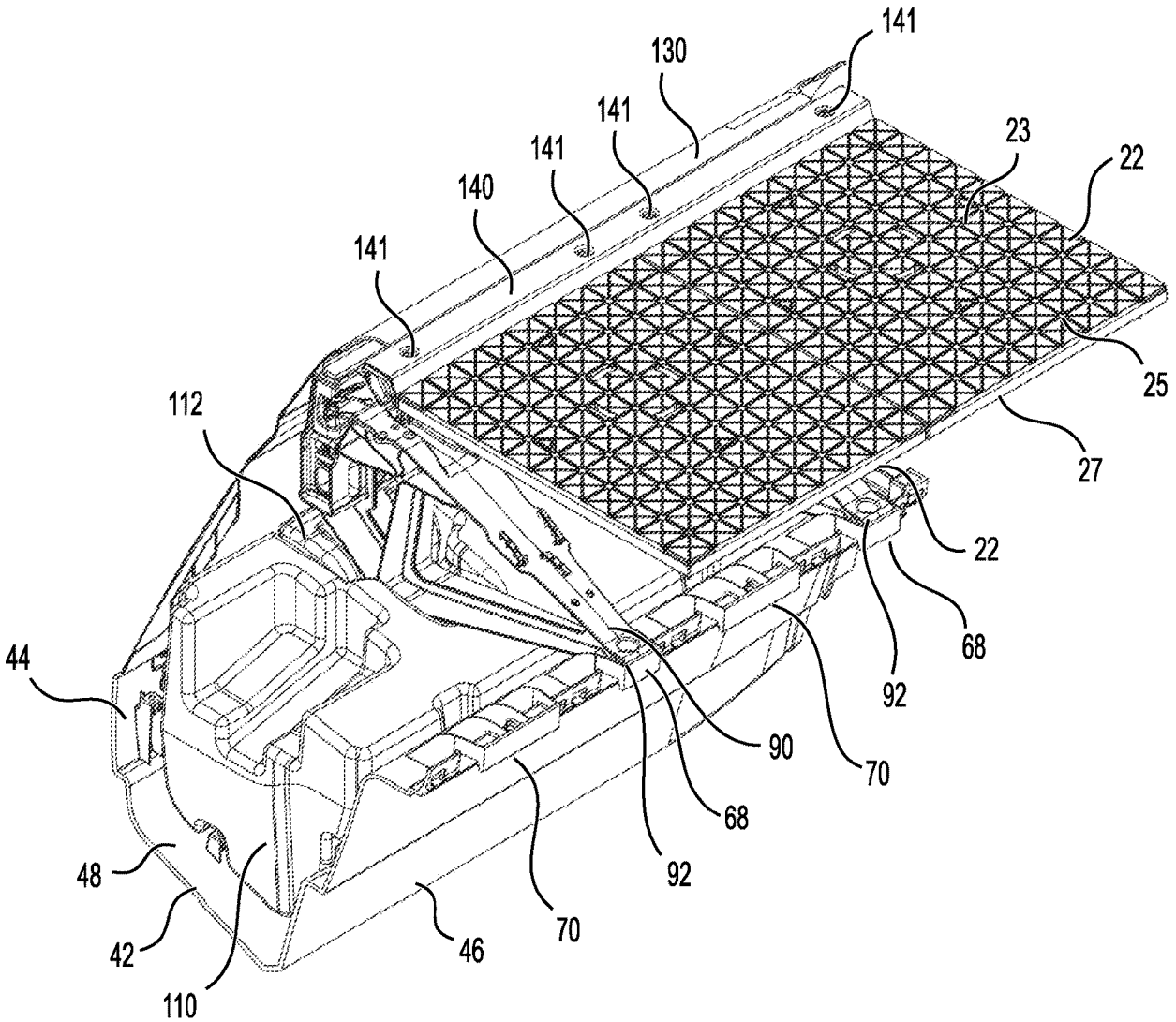
FIG. 14 is a perspective view, taken from a rear right side, of a hull unit of the left hull of FIG. 7, along with an associated part of the deck.

The tiles 22 can have various shapes in accordance with their position on the deck 20. For instance, as can be seen in FIG. 1, some of the tiles 22 along the periphery of the deck 20 are triangular to conform to an angular shape of the periphery of the boat 10. In other cases, some of the tiles 22 are generally rectangular (FIG. 14). As can be seen in FIG.

14, each of the tiles 22 has a gripping texture 25 formed on its upper surface 23. In this embodiment, the gripping texture 25 consists of a repeating triangular pattern. The gripping texture 25 may have a different pattern in other embodiments.

A more detailed description of the configuration of the tiles 22 and the manner in which they are used for attachment of accessories can be found in U.S. patent application Ser. No. 16/887,481, filed May 29, 2020, which is incorporated herein by reference.

It is contemplated that the deck 20 could have a different construction than that provided by the tiles 22. For instance, the deck 20 could have a more conventional construction such as including a metallic frame and an overlying flooring layer, such as wooden panels or plywood.

The boat 10 is propelled by a jet propulsion system 52 (FIGS. 1 and 5) powered by a motor (not shown). The jet propulsion system 52 has a steering nozzle 54 used for steering the boat 10. A handlebar (not shown) is operatively connected to the steering nozzle. A throttle lever (not shown) is operatively connected to the motor for controlling operation of the motor. The handlebar and the throttle lever are located on a command console provided on the deck 20. The command console is not shown in the figures in order to properly show the upper surface 24 of the deck 20. It is contemplated that other propulsion systems, such as a stern drive or a marine outboard engine, may be used to propel the boat 10. It is also contemplated that the handlebar could be replaced by a steering wheel and that the steering nozzle 54 could be replaced by an outdrive or one or more rudders.

A powerpack 50 (schematically illustrated in FIG. 7) of the boat 10, including the jet propulsion system 52 and the motor, is enclosed in part by the central hull 32. A central hull cover 34 overlies the powerpack 50 to partly enclose the powerpack 50 between the central hull 32 and the central hull cover 34. As shown in FIG. 1, an upper surface 35 of the central hull cover 34 is contiguous with the upper surface 24 of the deck 20 (i.e., flush therewith).

Figure 9:
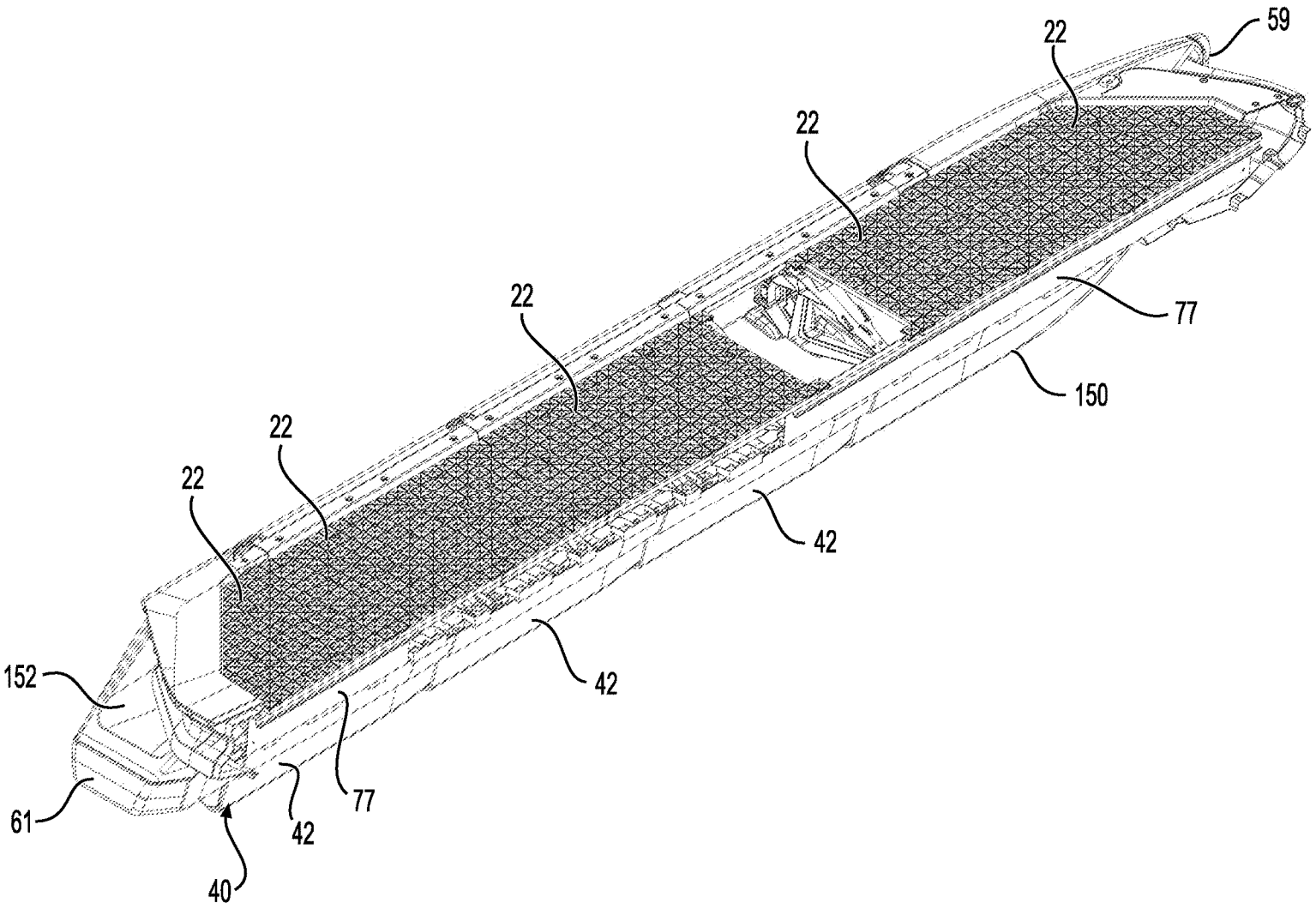
FIG. 9 is a perspective view, taken from a rear right side, of a left hull and an associated part of the deck of the pontoon boat of FIG. 1.
Figure 10:
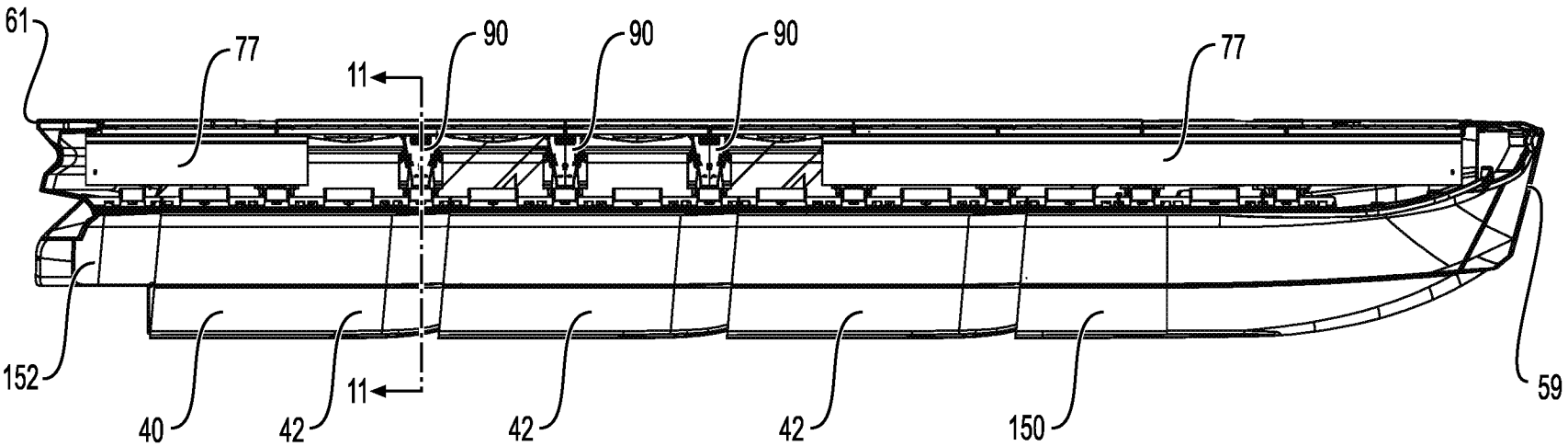
FIG. 10 is a right side elevation view of the left hull and the associated part of the deck of FIG. 7.

With reference to FIGS. 9 and 10, two vertical wall members 77 are provided on either lateral side of the central hull 32. The vertical wall members 77 are connected to the central hull cover 34. A rear one of the vertical wall members 77 extends rearwardly from the central hull cover 34 while a front one of the vertical wall members 77 extends forwardly from the central hull cover 34. The vertical wall members 77 support the tiles 22 of the deck 20 that extend thereabove.

Figure 8:
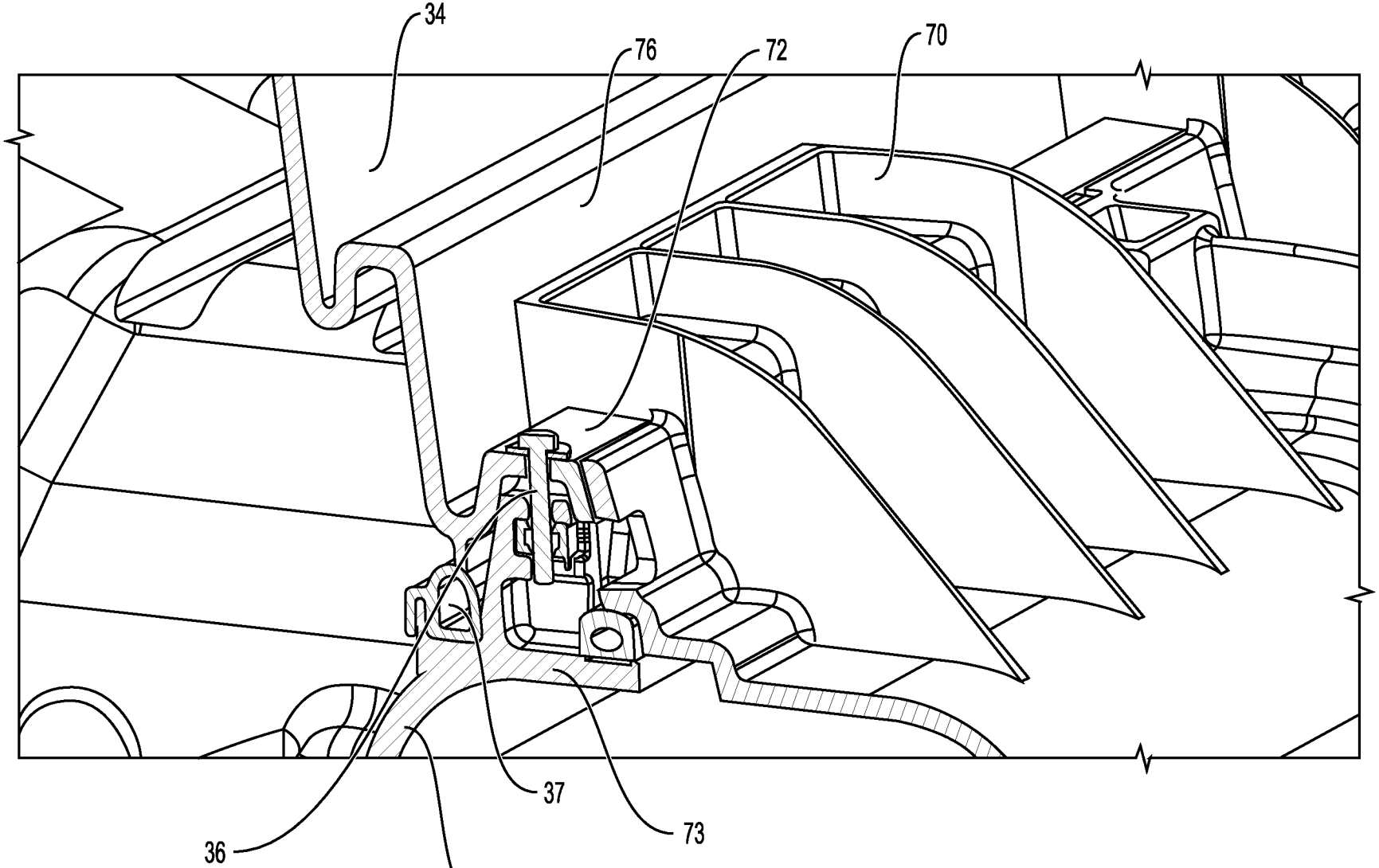
FIG. 8 is a perspective view of a cross-section taken along a connection between a central hull and a central hull cover of the pontoon boat of FIG. 1.

As shown in FIG. 8, the central hull cover 34 has two outer lateral ridges 72, one on each lateral side thereof. Each of the outer lateral ridges 72 of the central hull cover 34 is connected to a corresponding lateral flange 73 of the central hull 32. Notably, fasteners 36 (one of which is shown in FIG. 8) extend through the outer lateral ridge 72 and the lateral flange 73 to secure them to one another. A sealing member 37 is also secured between the central hull cover 34 and the central hull 32 to prevent the ingress of water therebetween.

The construction of each of the left and right hulls 40 will now be described with reference to FIGS. 9 to 13. As the right hull 40 is a mirror image of the left hull 40, only the left hull 40 will be described in detail herein. It is to be understood that the same description applies to the right hull 40 as well. As such, the left hull 40 will be referred to simply as lateral hull 40 in the below description.

As can be seen in FIGS. 9 and 10, the lateral hull 40 has three lower hull panels 42, as well as a front end cap 150 and a rear end cap 152. The lower hull panels 42 are positioned relative to one another such that consecutive ones of the lower hull panels 42 are longitudinally-adjacent to one another in an overlapping manner. The front end cap 150 is connected to the frontmost one of the lower hull panels 42 while the rear end cap 152 is connected to the rearmost one of the lower hull panels 42. As such, the front end cap 150 defines a front end 59 of the lateral hull 40 while the rear end cap 152 defines a rear end 61 of the lateral hull 40, a length of the lateral hull 40 being measured between the front and rear ends 59, 61. A number of the tiles 22 that form part of the deck 20 extend over the lateral hull 40 and are connected thereto in a manner that will be explained in greater detail below.

The lower hull panels 42 are mounted to the central hull 32 and form in part a running surface 45 (FIGS. 2, 3) of the boat 10 which engages the water during travel of the boat 10. The lower hull panels 42 are identical to one another and thus a single one of the lower hull panels 42 will be described herein with reference to FIGS. 19 to 23.

Figure 19:
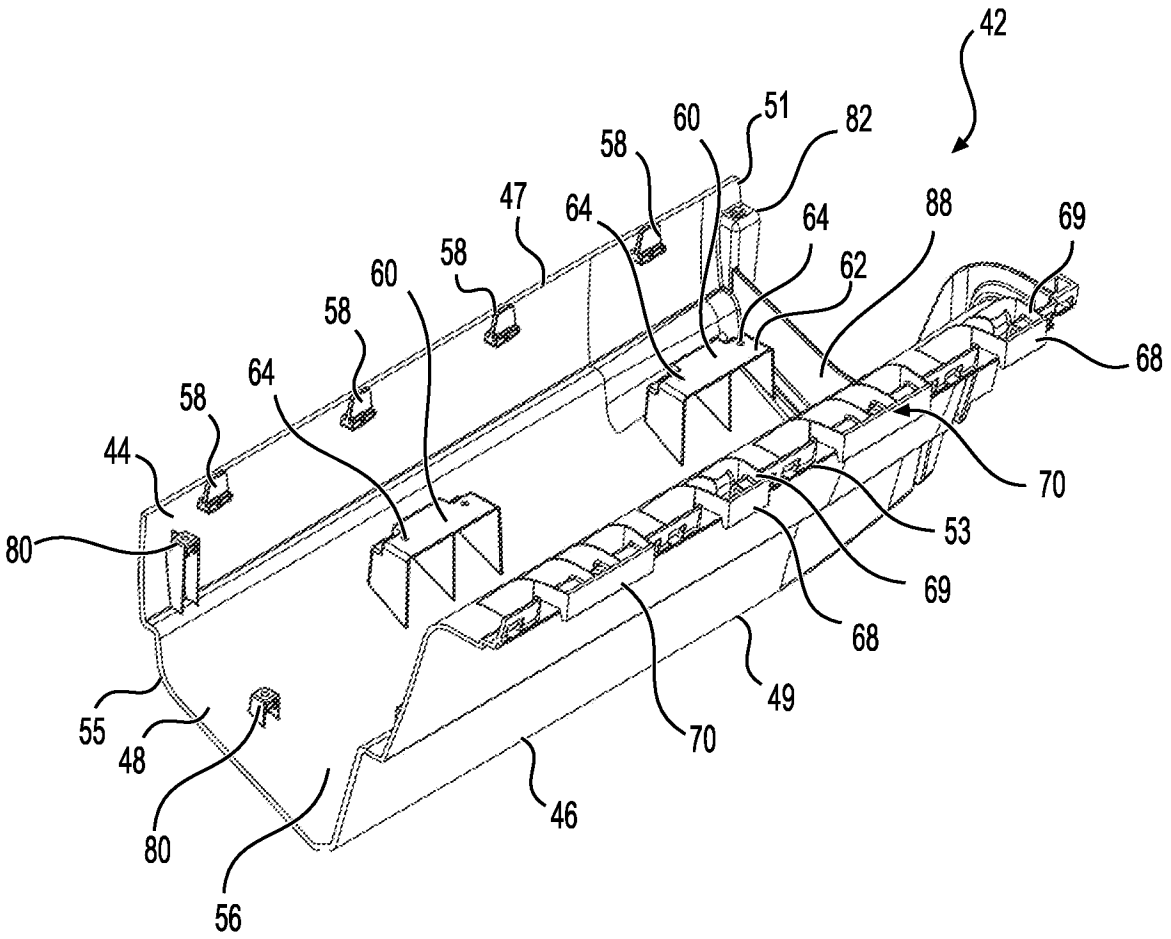
FIG. 19 is a perspective view, taken from a rear right side, of a lower hull panel of the hull unit of FIG. 14.
Figure 20:
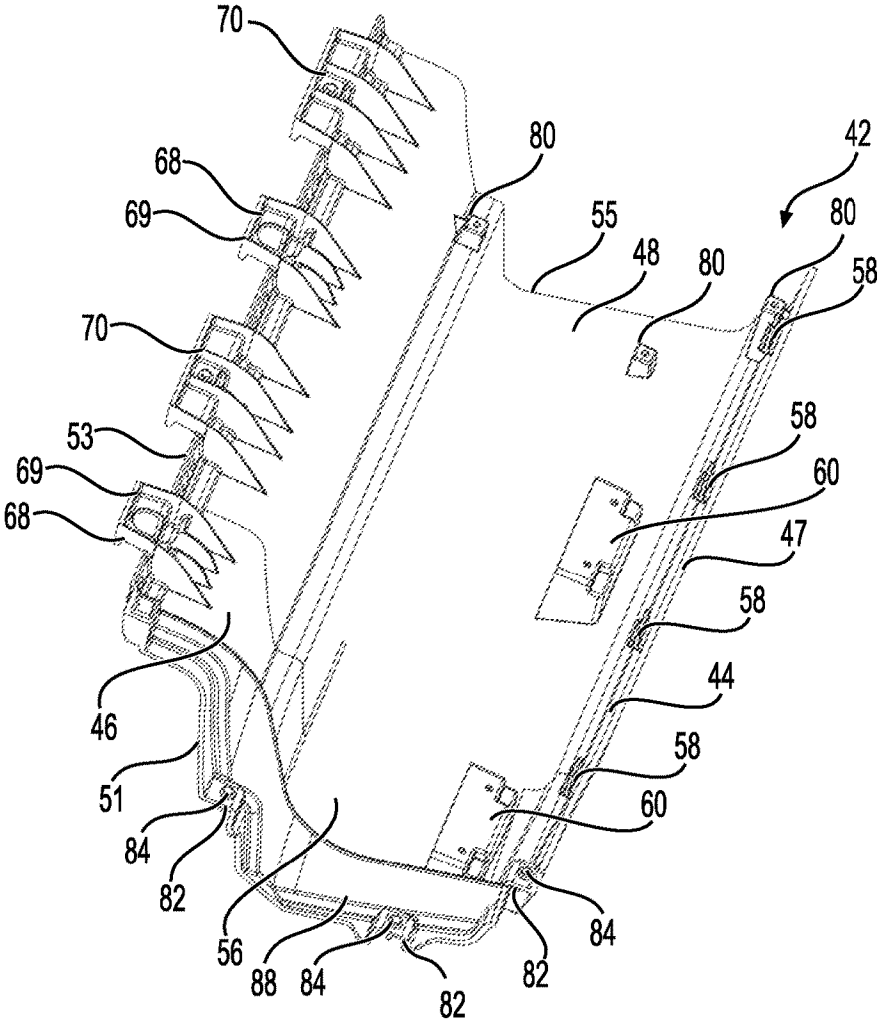
FIG. 20 is a perspective view, taken from a front left side, of the lower hull panel of FIG. 19.
Figure 21:
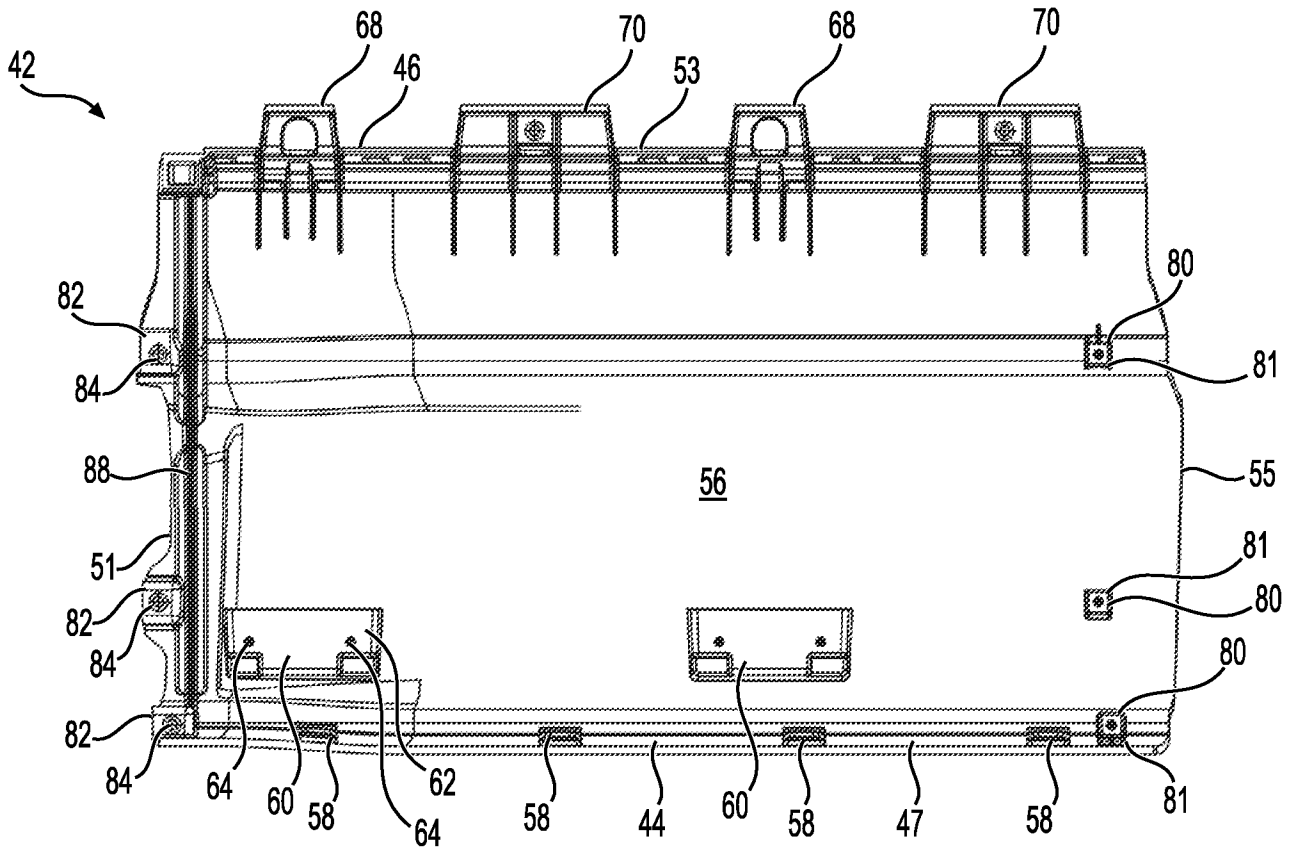
FIG. 21 is a top plan view of the lower hull panel of FIG. 19.
Figure 23:
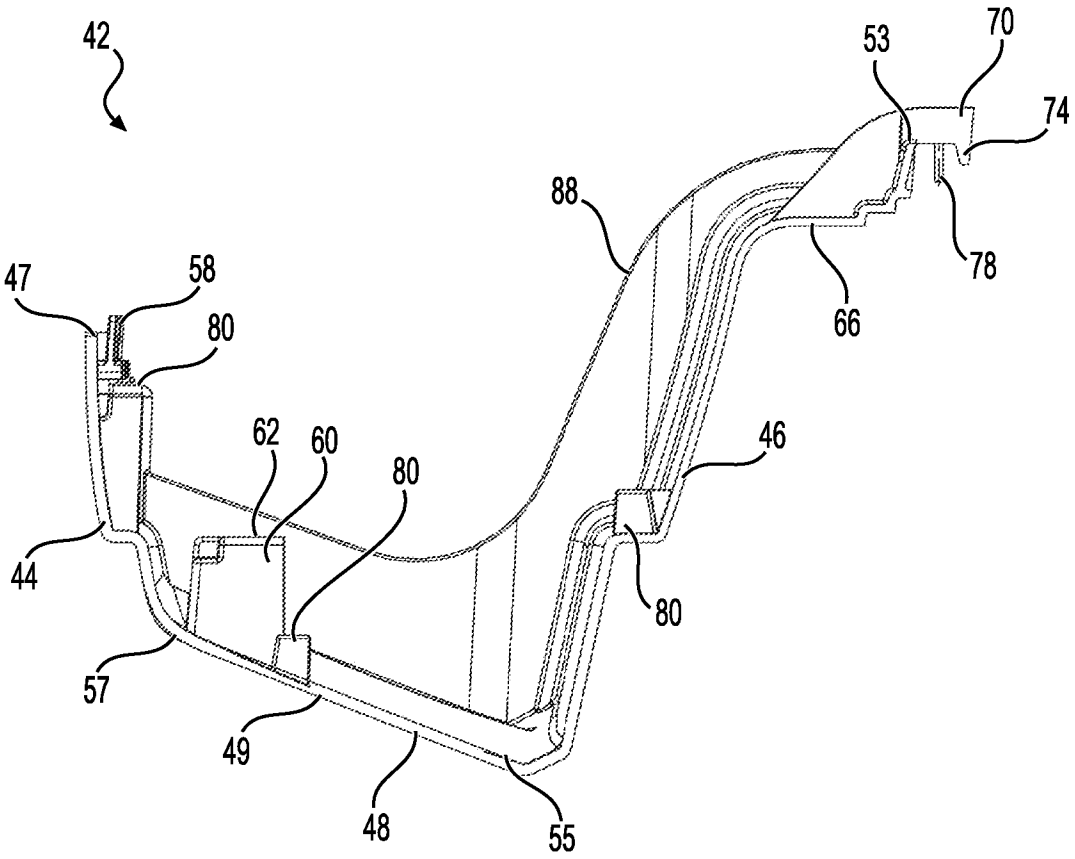
FIG. 23 is a rear elevation view of the lower hull panel of FIG. 19.

As can be seen in FIGS. 19, 20 and 23, the lower hull panel 42 is generally U-shaped and has an outer lateral wall 44, an inner lateral wall 46 opposite the outer lateral wall 44, and a bottom wall 48 extending between the outer and inner lateral walls 44, 46. The outer and inner lateral walls 44, 46 extend upwardly from the bottom wall 48. Together, the walls 44, 46, 48 form an outer surface 49 (which forms part of the running surface 45 of the boat 10) and an inner surface 56 of the lower hull panel 42. A chine 57 (FIG. 23) is formed in between outer lateral wall 44 and the bottom wall 48 of the lower hull panel 42. The outer lateral wall 44 defines an outer edge 47 of the lower hull panel 42 while the inner lateral wall 46 defines an inner edge 53 of the lower hull panel 42. As can be seen in FIG. 23, the outer edge 47 is vertically lower than the inner edge 53.

As shown in FIG. 19, four projections 58 extend upwardly from a portion of the inner surface 56 formed by the outer lateral wall 44 for connecting the lower hull panel 42 to a corresponding side panel, which will be described in greater detail below. Each projection 58 has a generally trapezoidal shape. Furthermore, two brace mounts 60 extend upwardly from a portion of the inner surface 56 formed by the bottom wall 48 for connecting respective braces thereto, as will be described in greater detail below. Each brace mount 60 has an upper flat surface 62 extending horizontally which defines two openings 64 which are configured for receiving fasteners therein.

Figure 24:
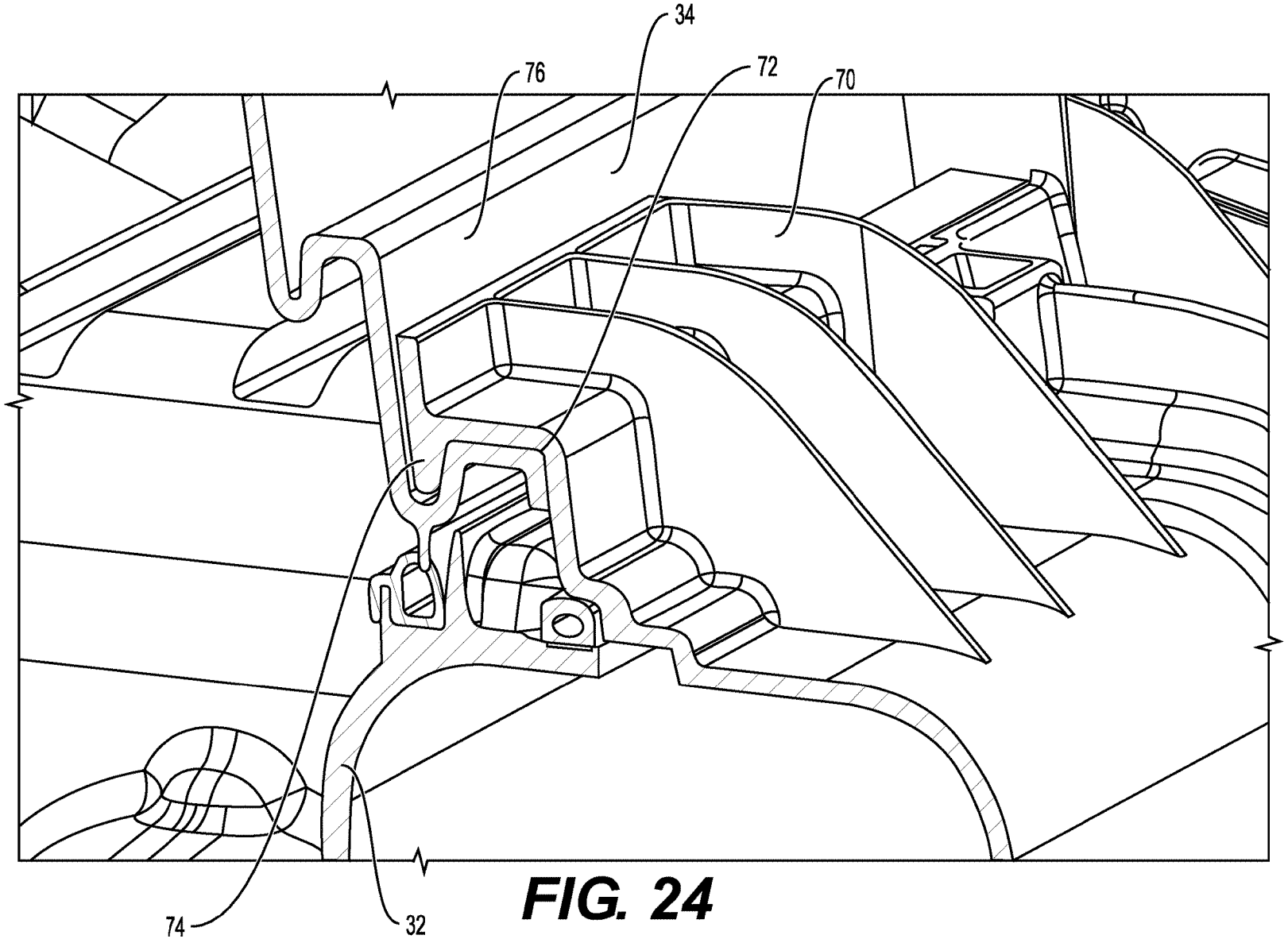
FIG. 24 is a perspective view of a cross-section taken along a connection between an interlocking portion of the lower hull panel of FIG. 19 and the central hull cover.

As can be seen in FIG. 23, the inner lateral wall 46 has an end portion 66 that extends laterally inwardly (i.e., towards the central hull 32). The end portion 66 defines the inner edge 53 of the lower hull panel 42. The lower hull panel 42 has interlocking portions 68, 70 that extend laterally inwardly from the end portion 66 of the inner lateral wall 46, adjacent to the inner edge 53. The interlocking portions 68, 70 are configured for interlocking with a complementary portion of the central hull 32 so as to retain the left hull 40 to the central hull 32. Notably, the interlocking portions 68, 70 are shaped as downwardly-facing hooks adapted to hook onto the corresponding outer lateral ridge 72 of the central hull cover 34, as shown for example for one of the interlocking portions 70 in FIG. 24. In particular, an end 74 of each of the hook-shaped interlocking portions 68, 70 is inserted into a space defined between the outer lateral ridge 72 and an adjacent vertical wall 76 of the central hull cover 34. The outer lateral ridge 72 is positioned in a recess defined by opposite walls of each of the hook-shaped interlocking portions 68, 70. A fastener 78 (FIG. 23) is inserted into a corresponding opening defined by a respective interlocking portion 70 to secure that interlocking portion 70 to the central hull cover 34.

As some of the lower hull panels 42, as well as the front end cap 150 (which has similar interconnecting portions as the lower hull panels 42), extend forwardly or rearwardly of the central hull cover 34—and therefore cannot be hooked thereto in the same manner—the boat 10 also has two lateral braces 79 (FIGS. 6, 7) that form part of the central frame 30, and extend between the left and right hulls 40 below the tiles 22. The lateral extremities of the lateral braces 79 have a same profile as the central hull cover 34, notably defining an outer lateral ridge similar to the outer lateral ridge 72 to which the interconnecting portions 68, 70 (or those of the front end cap 150) can be interlocked with.

As shown in FIGS. 19 and 20, the lower hull panel 42 has three lower panel mounts 80 for connecting the lower hull panel 42 to an adjacent lower hull panel 42. The lower panel mounts 80 extend upwardly from the inner surface 56 of the lower hull panel 42. More particularly, the lower panel mounts 80 are laterally spaced apart from one another such that the lower panel mounts 80 extend upwardly from portions of the inner surface 56 formed by the outer lateral wall 44, the inner lateral wall 46 and the bottom wall 48 respectively. The lower panel mounts 80 are located near a rear longitudinal end 55 of the lower hull panel 42. Each lower panel mount 80 has an upper surface 81 defining an opening for receiving a corresponding fastener 84 therein.

As can be seen in FIG. 20, the lower hull panel 42 also has three lower panel connecting flanges 82 at a front longitudinal end 51 of the lower hull panel 42. The lower panel mounts 80 and the lower panel connecting flanges 82 are corresponding structures for connecting adjacent ones of the lower hull panels 42. To that end, each lower panel connecting flange 82 is laterally aligned with a corresponding lower panel mount 80. Each lower panel connecting flange 82 defines an opening for receiving a corresponding fastener 84 therein.

The lower hull panel 42 also has a limiting wall 88 for positioning a buoyant element 110 which will be described in greater detail below. The limiting wall 88 extends generally laterally near the front longitudinal end 51 of the lower hull panel 42. Notably, the lower panel connecting flanges 82 extend forwardly from the limiting wall 88. The limiting wall 88 extends from the outer lateral wall 44 to the inner lateral wall 46.

In this embodiment, the lower hull panels 42 are molded components (i.e., formed via molding). Notably, the molding of the lower hull panels 42 is particularly economic since the lower hull panels 42 are identical and thus less tooling is necessary for their molding than if each lower hull panel 42 had a different configuration.

Figure 22:
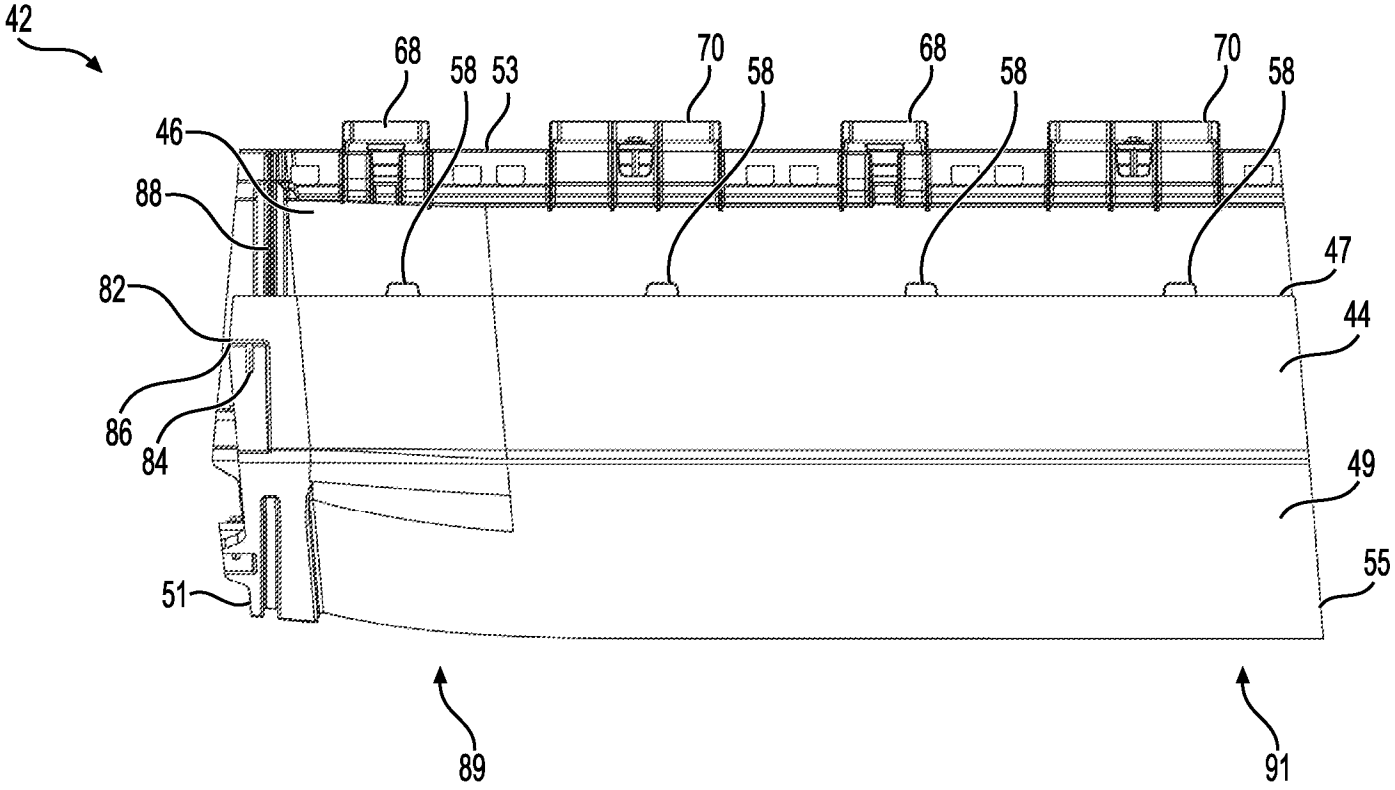
FIG. 22 is a left side elevation view of the lower hull panel of FIG. 19.

As will be explained below, consecutive ones of the lower hull panels 42 are positioned relative to one another and connected via the lower panel mounts 80 and the lower panel connecting flanges 82 thereof. In particular, in order to connect two consecutive ones of the lower hull panels 42, the outer and inner lateral walls 44, 46 thereof are generally aligned with one another and the rear one of the two lower hull panels 42 (i.e., the lower hull panel 42 that is meant to be rearward of the other) is positioned such that a front portion 89 thereof is surrounded by a rear part of the inner surface 56 of the front one of the two lower hull panels 42. As can be seen in FIG. 22, the dimensions of the front portion 89 of each lower hull panel 42 are smaller than the dimensions of a rear portion 91 thereof, namely as the bottom wall 48 extends upwardly at the front portion 89. The two lower hull panels 42 are positioned such that the lower panel connecting flanges 82 of the rear one of the two lower hull panels 42 overlay the lower panel mounts 80 of the front one of the two lower hull panels 42 such that a lower surface 86 of each lower panel connecting flange 82 of the rear one of the two lower hull panels 86 mates with the upper surface 81 of the corresponding lower panel mount 80 of the front one of the two lower hull panels 42. The fasteners 84 are then inserted into the aligned openings of the lower panel connecting flanges 82 and the lower panel mounts 80 and secured (e.g., with corresponding receiving nuts).

As will be appreciated, while in this embodiment the lateral 40 has three lower hull panels 42, any number of lower hull panels 42 can be connected to form the lateral hull 40. As such, this construction allows adapting the length of the lateral hull 40 as desired simply by including more or fewer lower hull panels 42 (and corresponding braces and floating members as will be discussed below). Thus, different length models of the boat 10 can be produced by varying the number of modular components that make up the lateral hull 40.

Figure 4:
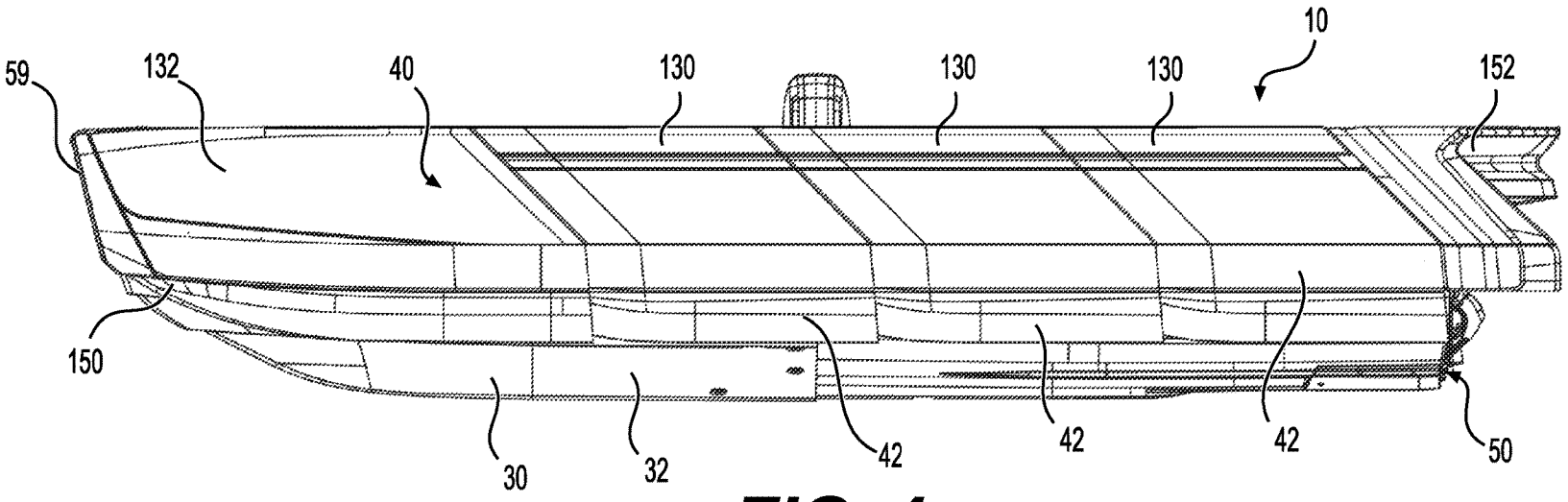
FIG. 4 is a left side elevation view of the pontoon boat of FIG. 1.
Figure 5:
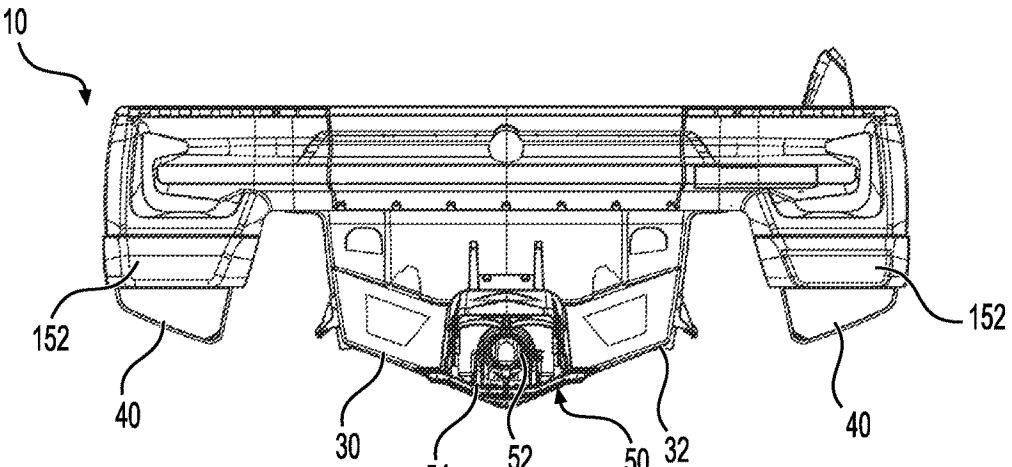
FIG. 5 is a rear elevation view of the pontoon boat of FIG. 1.
Figure 12:
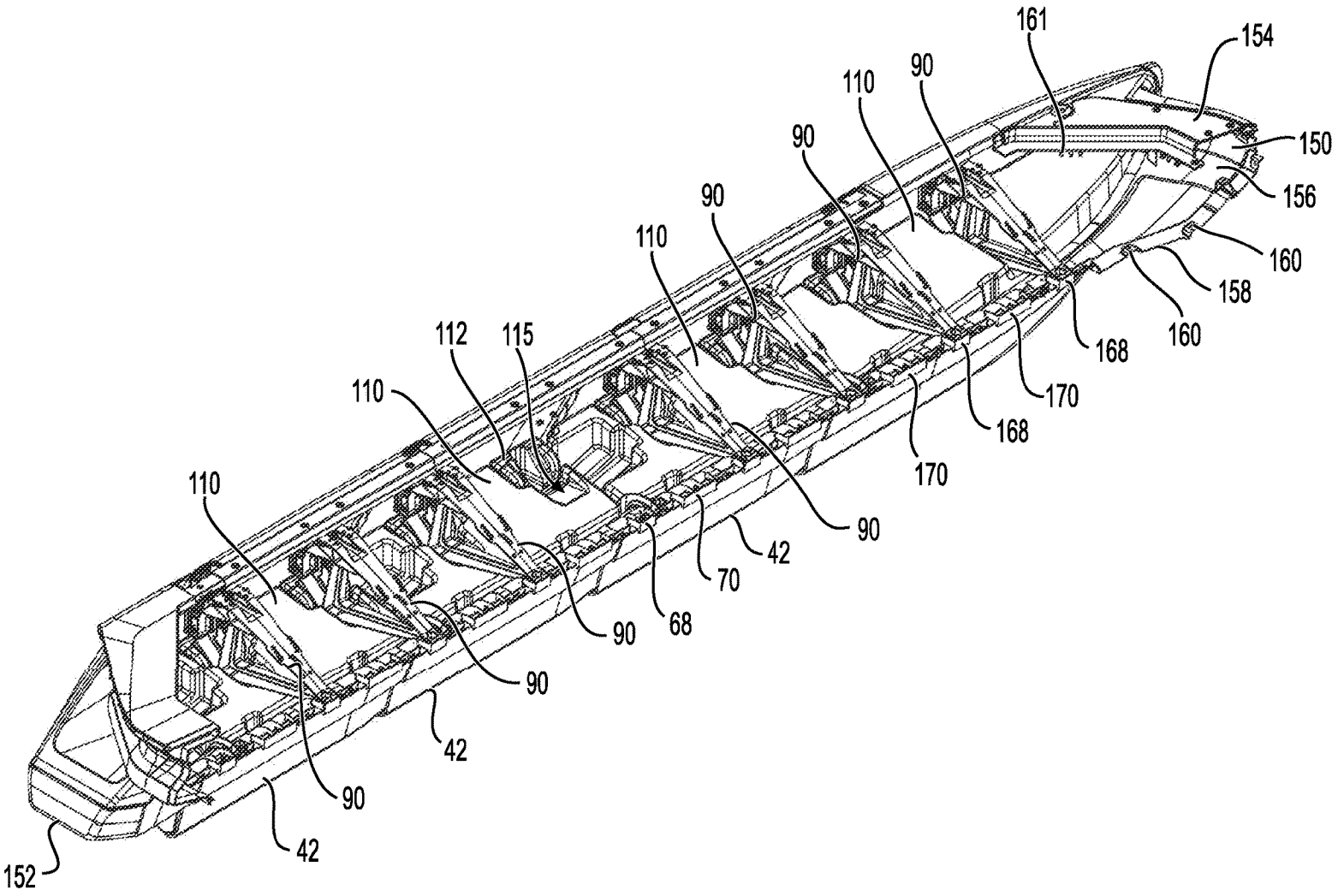
FIG. 12 is a perspective view, taken from a rear right side, of the left hull of FIG. 7.

As can be seen in FIG. 12, the front end cap 150 of the lateral hull 40 is configured in part similarly to the lower hull panels 42. Notably, part of the front end cap 150 has a cross-sectional profile similar to that of the lower hull panels 42. The front end cap 150 also has interlocking portions 168, 170, similar to the interlocking portions 68, 70, which are configured for interlocking with the outer lateral ridge formed by the lateral braces 79. As shown in FIG. 4, a front portion of the front end cap 150 curves upwardly to a greater extent than the front portion 89 of the lower hull panel 42, namely to form a bow shape of the lateral hull 40 and to provide lift when the boat 10 accelerates. The shape of the front end cap 150 can also provide splash deflection when the boat 10 is underway.

The front end cap 150 is closed at its front end 151 to form the closed front end 59 of the lateral hull 40. The front end cap 150 has a laterally-extending portion 154 having a front wall 156 that is in part laterally aligned with the buoyant elements 110 of the lateral hull 40. The laterally-extending portion 154 has a connecting flange 158 which has a plurality of mounts 160 for fastening the laterally-extending portion 154 to the central frame 30. An upper flange 161 of the laterally-extending portion 154 is configured to support one of the tiles 22. The buoyant element 110 received in the front end cap 150 has a length greater than that of the buoyant elements 110 received in each of the lower hull panels 42. Three braces 90 are received in respective recesses 115 of the buoyant element 110 received in the front end cap 150.

Figure 30:
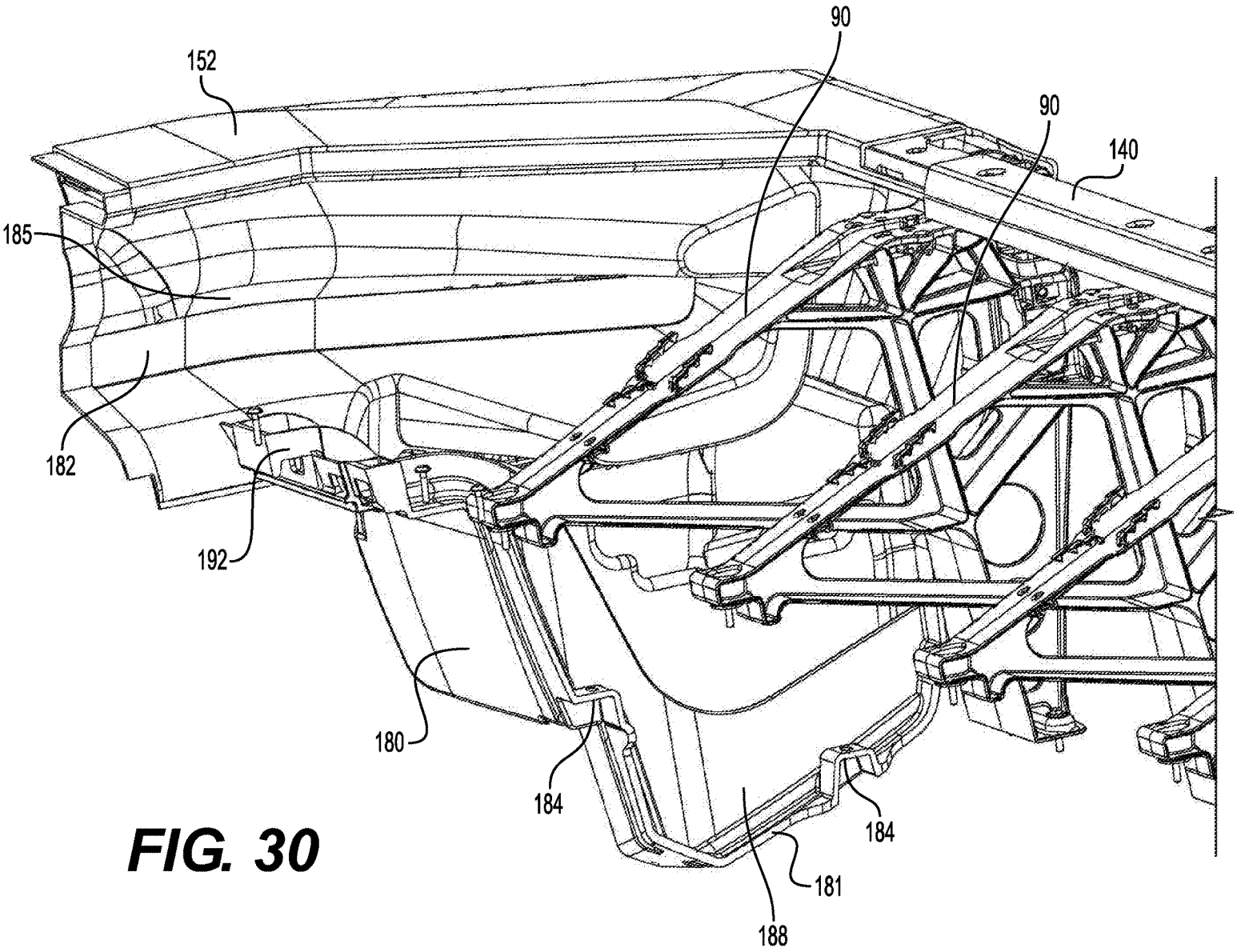
FIG. 30 is a perspective view, taken from a front right side, of part of the left hull of FIG. 7, showing an inner side of a rear end cap of the left hull.

The rear end cap 152 defines the closed rear end 61 of the lateral hull 40. Notably, with reference to FIG. 30, the rear end cap 152 has a lower portion 180 and an upper portion 182 which, together, form a rear wall 185 that is in part laterally aligned with the buoyant elements 110 of the lateral hull 40. The lower portion 180 has three lower connecting flanges 184 (one of which is hidden from view in FIG. 30) at a front longitudinal end 181 thereof. The lower connecting flanges 184 are similar to the lower panel connecting flanges 82 of the lower hull panels 42. Notably, the lower panel mounts 80 and the lower connecting flanges 184 are corresponding structures for connecting the rear end cap 152 to the rearmost one of the lower hull panels 42. To that end, each lower panel flange 184 is laterally aligned with a corresponding lower panel mount 80 of the rearmost one of the lower hull panels 42. Each lower connecting flange 184 defines an opening for receiving a corresponding fastener therein.

The rear end cap 152 has an interlocking portion 192 similar to the interlocking portion 68 of the lower hull panels 42. The interlocking portion 192 is configured to interlock with the outer lateral ridge formed by the lateral braces 79.

Returning now to FIGS. 12 to 14, the lateral hull 40 also has a plurality of braces 90 (two per lower hull panel 42) configured for reinforcing the lateral hull 40 so as to support loads exerted thereon. As can be seen, one of the braces 90 of the lateral hull 40 is missing in FIG. 12 to show where that brace would attach. The braces 90 are longitudinally spaced apart from one another and are connected between the central hull 32, the lower hull panels 42 and the deck 20. With additional reference to FIGS. 25 to 28, each brace 90 has a laterally inner mount 92 connected to the central hull 32, a lower mount 94 connected to a corresponding lower hull panel 42, and an upper mount 96 connected to the deck 20. The inner mount 92 is positioned vertically between the lower and upper mounts 94, 96.

Figure 29:
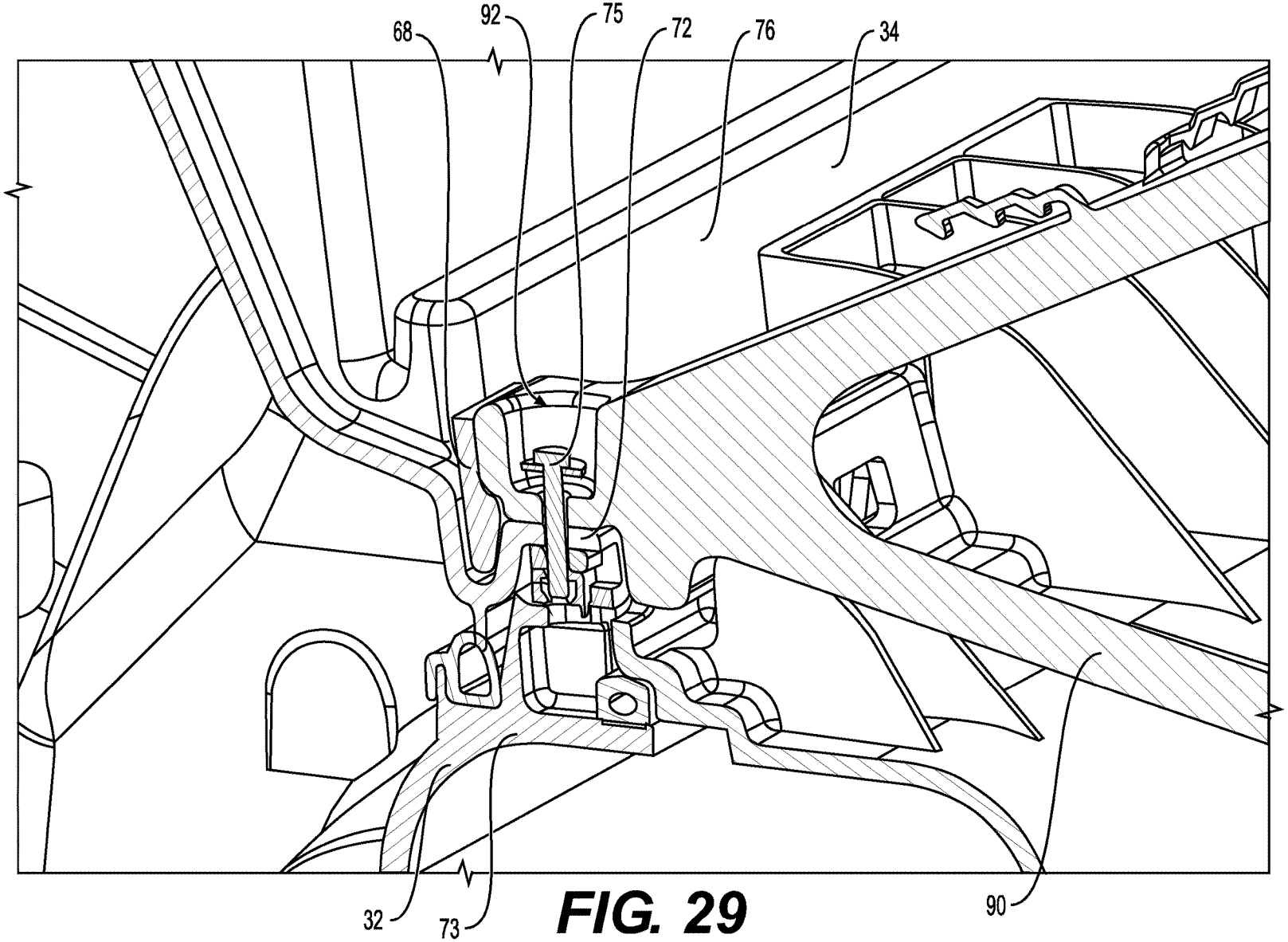
FIG. 29 is a perspective view of a cross-section take along a connection between the brace of FIG. 25 and the central hull cover.

The connection between the inner mount 92 and the central hull 32 is shown in greater detail in FIG. 29. As can be seen, the inner mount 92 is received atop a corresponding one of the interlocking portions 68, in a pocket 69 defined thereby (FIGS. 19, 20). A fastener 75 extends through an opening defined by the inner mount 92 and into an aligned opening defined by a corresponding outer lateral ridge 72 of the central hull cover 34. A nut secures the fastener 75 to retain the brace 90 to the central hull cover 34.

The lower mount 94 of each brace 90 is connected to a brace mount 60 of the corresponding lower hull panel 42 by fasteners 97 that extend through openings defined by the lower mount 94 and through the openings 64 defined by the brace mount 60.

Figure 15:
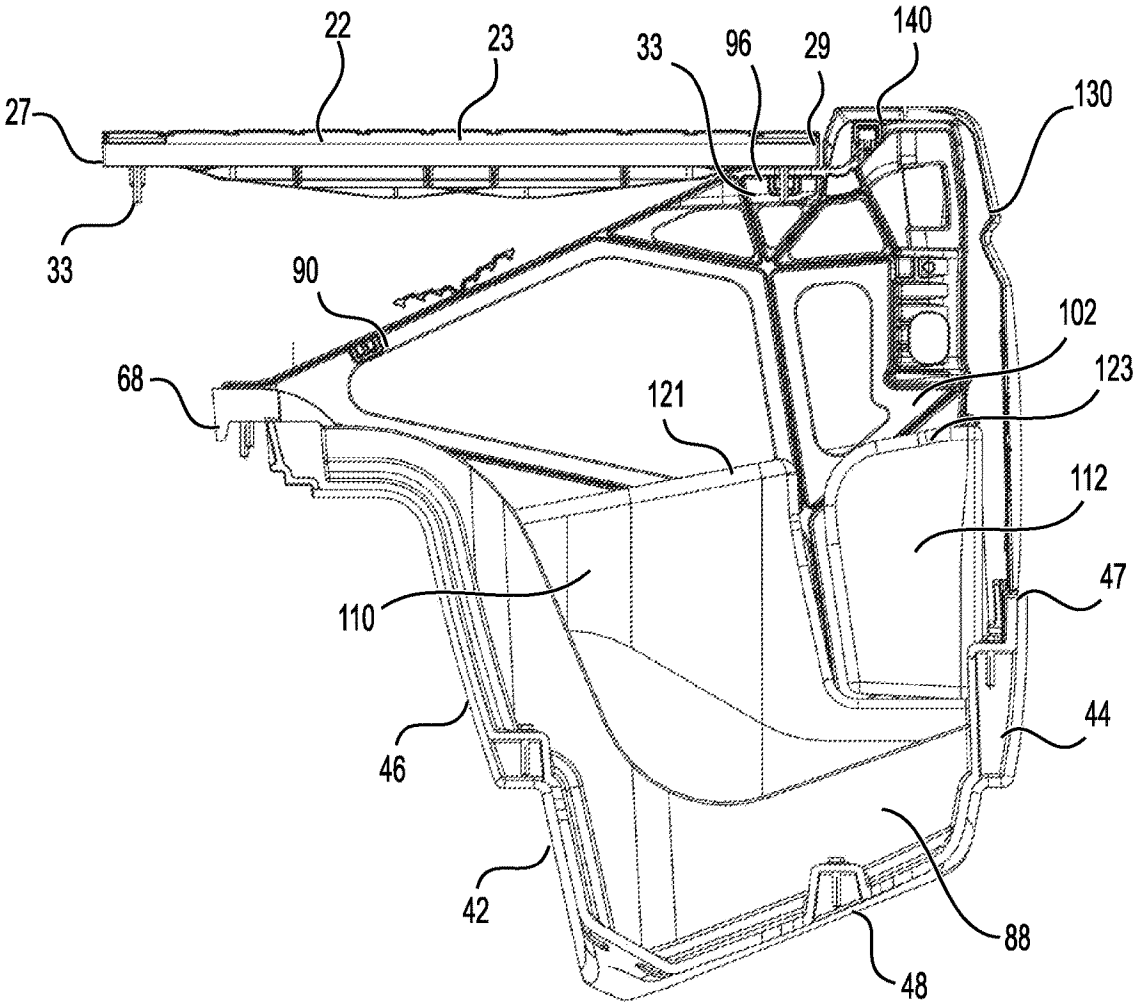
FIG. 15 is a front elevation view of the components of FIG. 14.
Figure 25:
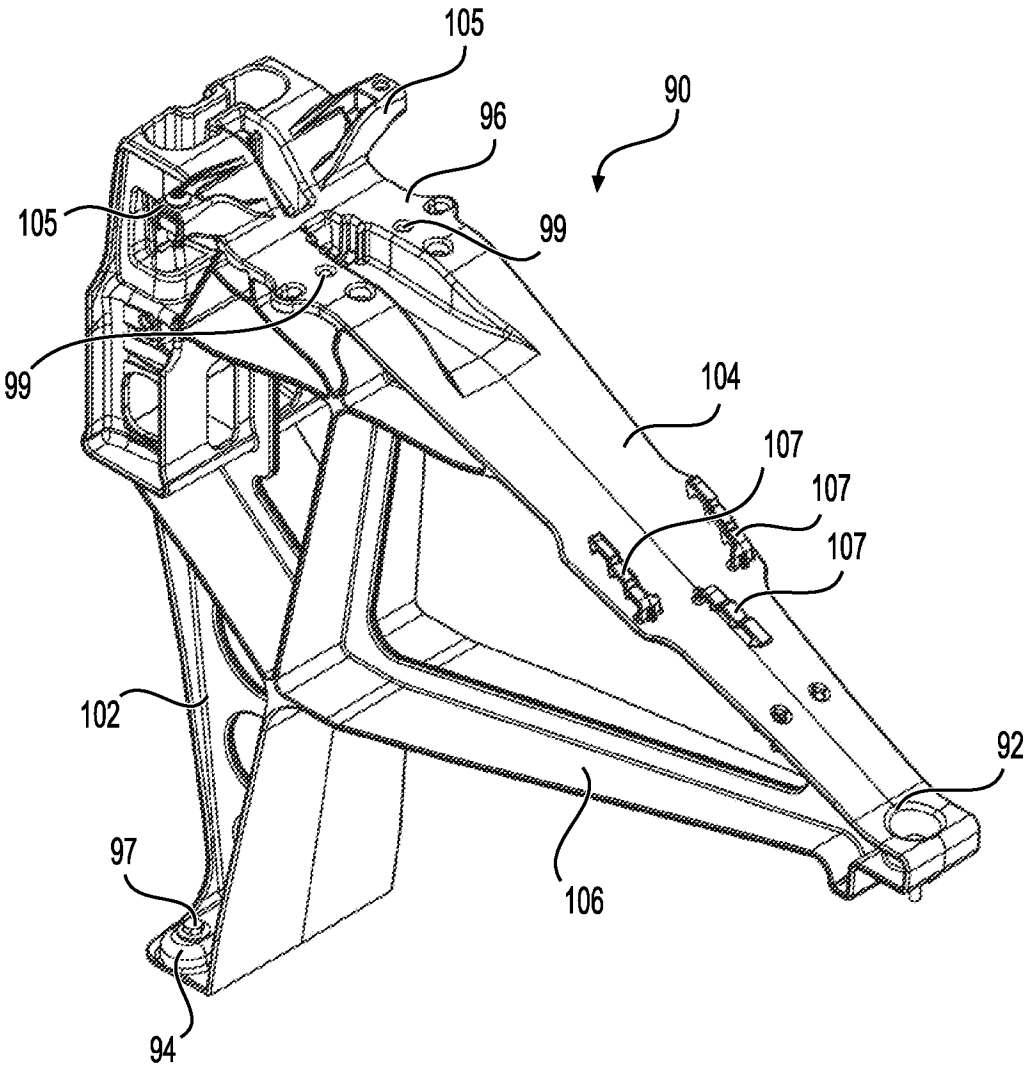
FIG. 25 is a perspective view, taken from a rear right side, of a brace of the of the hull unit of FIG. 14.

As shown in FIG. 15, the upper mount 96 of each brace 90 is configured for connection to the tiles 22 of the deck 20. Notably, each of the tiles 22 that extends over the lower hull panels 42 of the lateral hull 40 is connected along an inner edge 27 thereof to at least one of the central hull cover 34 and the lateral braces 79, and along an outer edge 29 thereof to the upper mounts 96 of the braces 90. As such, the tiles 22 that extend over the lower hull panels 42 are structural members which support loads exerted thereon. As can be seen in FIG. 25, the upper mounts 96 define openings 99 for receiving respective fasteners 33 (FIG. 15) that extend downwardly from the corners of the tiles 22. The braces 90 have fasteners which receive the respective fasteners 33 so as to retain the tiles 22 onto the upper mounts 96.

With reference to FIGS. 25 to 28, each brace 90 has three beam portions 102, 104, 106 that extend substantially linearly. Notably, the upstanding beam portion 102 extends between the upper mount 96 and the lower mount 94 and thus extends generally vertically. The upper beam portion 104 extends between the inner mount 92 and the upper mount 96. The lower beam portion 106 extends between the inner mount 92 and the upstanding beam portion 102. For instance, in this embodiment, the lower beam portion 106 extends between the inner mount 92 and a point approximately midway between the ends of the upstanding beam portion 102. However, it is contemplated that the lower beam portion 106 may extend between the inner mount 92 and the lower mount 94 in other embodiments, or between the inner mount 92 and any other point of the upstanding beam portion 102. This configuration of the beam portions 102, 104, 106 provides support for the lateral hull 40 while simultaneously remaining compact so as to adapt to the limited space available within the lateral hull 40.

In this embodiment, the braces 90 are made from plastic material. More specifically, the braces 90 are formed via molding the plastic material. It is contemplated that the braces 90 could be made differently, and from a different material, in other embodiments. For example, in some embodiments, the braces 90 could be made from aluminum.

Figure 11:
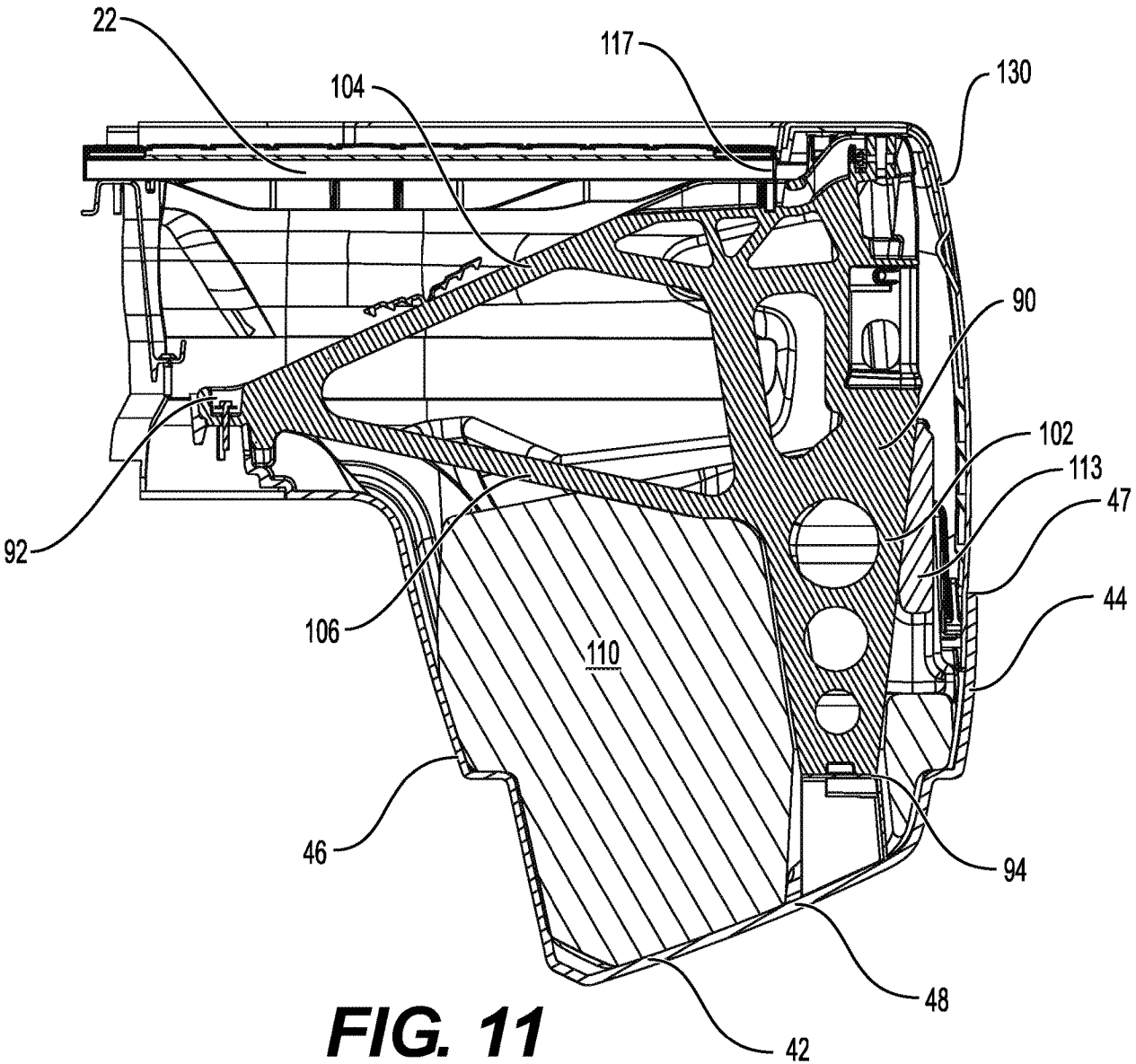
FIG. 11 is a cross-sectional view of the left hull and the associated part of the deck of FIG. 7 taken along line 11-11 in FIG. 10.

Returning now to FIG. 13, the lateral hull 40 also has buoyant elements 110, 112 received in a space defined between the lower hull panels 42 and the deck 20. The buoyant elements 110, 112 provide buoyancy to the lateral hull 40. In this embodiment, the buoyant elements 110, 112 are made of closed-cell foam material and may thus be referred to as "foam blocks". It is contemplated that the buoyant elements 110, 112 could be made of any other suitable foam material in other embodiments. However, it is contemplated that the buoyant elements 110, 112 could consist of other types of buoyant elements in other embodiments (e.g., inflatable bags, plastic containers, etc.). As shown in FIG. 11, the foam buoyant elements 110, 112 are shaped and sized to conform to the outer lateral walls 44, inner lateral walls 46 and bottom walls 48 of the lower hull panels 42 and to accommodate the braces 90.

Figure 16:
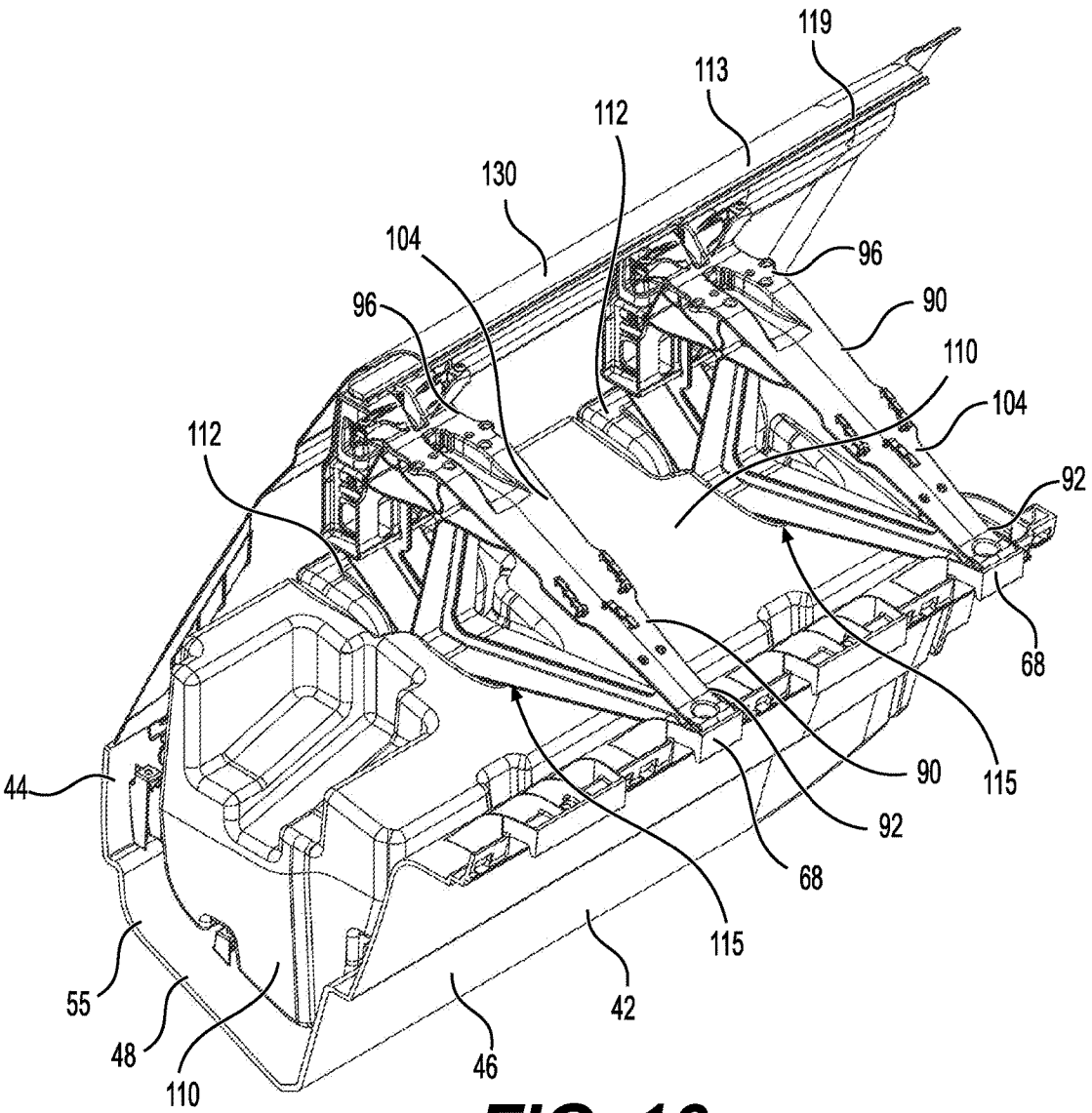
FIG. 16 is a perspective view of the hull unit of FIG. 14.

As can be seen in FIG. 16, in this embodiment, each buoyant element 110 has a length measured longitudinally that is less than a length of a corresponding lower hull panel 42 (measured between the front and rear longitudinal ends 51, 55 thereof). Each buoyant element 110 has a pair of recesses 115 for receiving corresponding ones of the braces 90 therein as well as a corresponding one of the buoyant elements 112. Notably, each recess 115 receives part of the beam portions 102, 106 therein. A buoyant element 112 is received in the recess 115 as well so as to surround the portion of the brace 90 that is received in the recess 115 with the material of the buoyant elements 110, 112.

The buoyant elements 110, 112 substantially fill the space defined between the lower hull panels 42 and the deck 20. That is, the buoyant elements 110, 112 fill a majority of the space defined between the lower hull panels 42 and the deck 20. The remainder of the space defined between the lower hull panels 42 and the deck 20 which is not filled by the buoyant elements 110, 112 can be used for other components of the boat 10, such as wiring for example. More specifically, in this embodiment, wiring extends through a gap defined between the respective upper surface 121, 123 of each buoyant element 110, 112 and the deck 20. Clips 107 (FIG. 25) provided on the upper beam portion 104 are configured for retaining the wiring to the braces 90.

Figure 6:
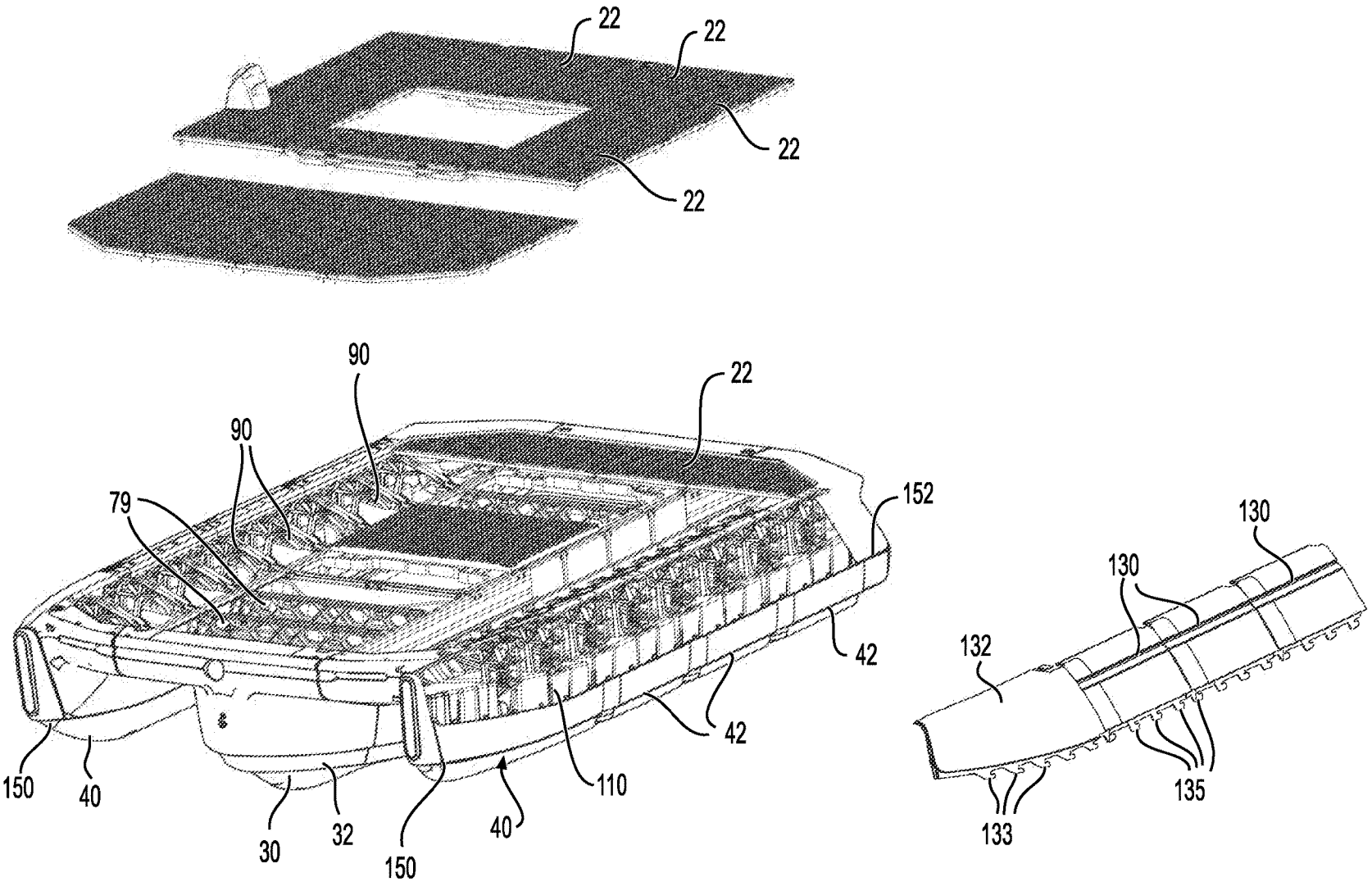
FIG. 6 is a partially exploded view of the pontoon boat of FIG. 1.
Figure 7:
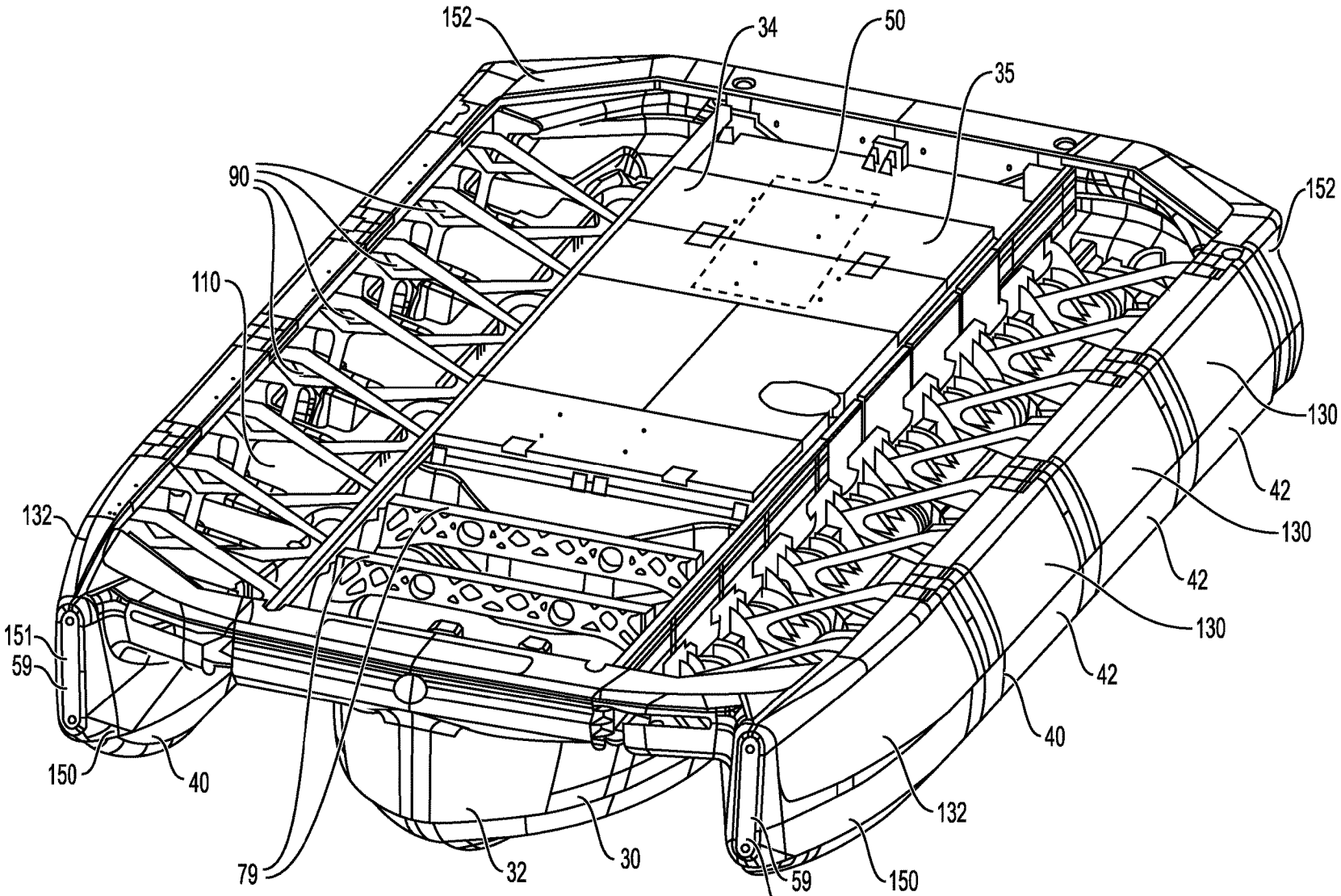
FIG. 7 is a perspective view, taken from a front left side, of the pontoon boat of FIG. 1 with a deck thereof removed to expose the underlying components.
Figure 13:
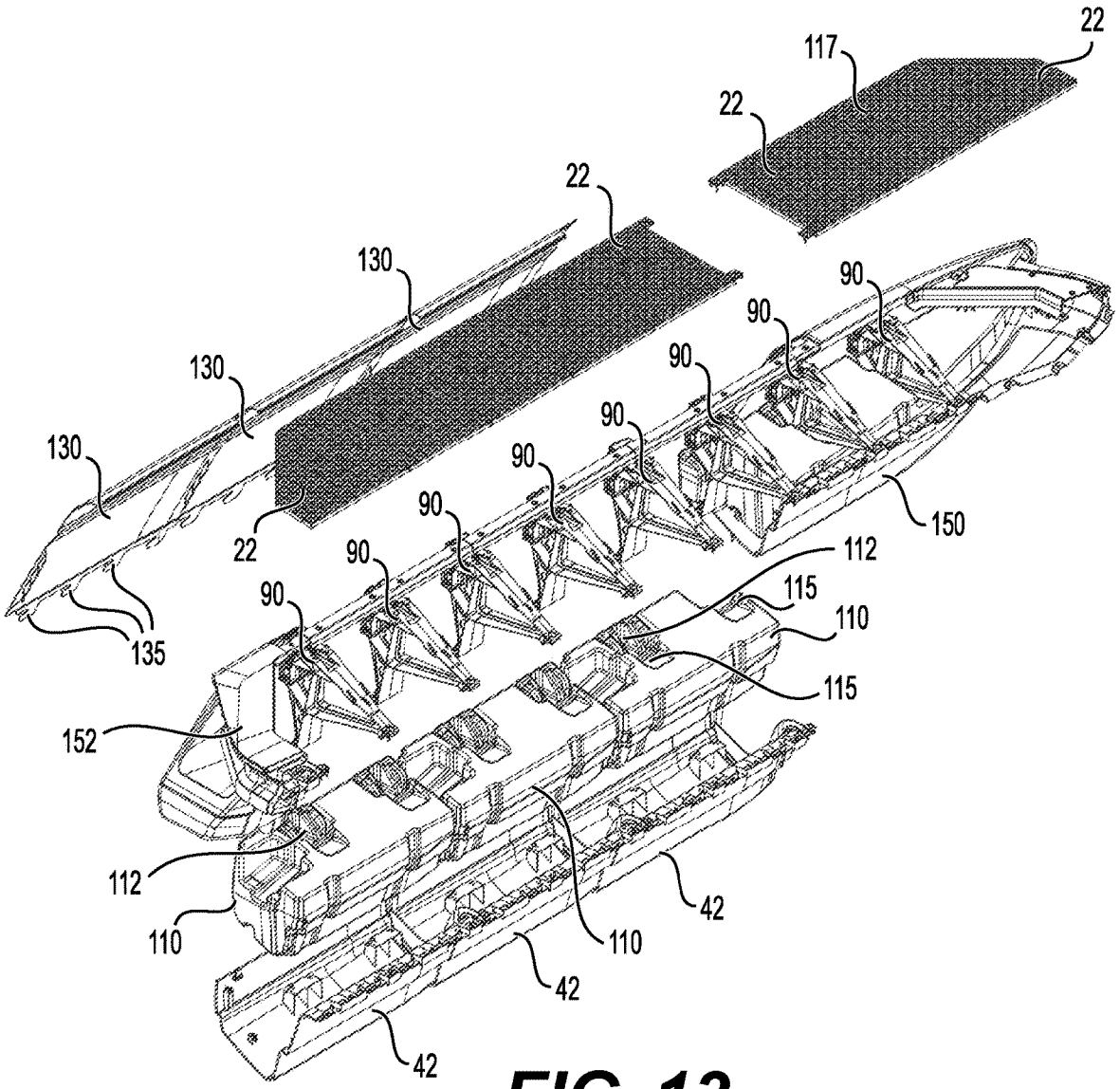
FIG. 13 is an exploded view of the left hull and the associated part of the deck of FIG. 7.
Figure 18:
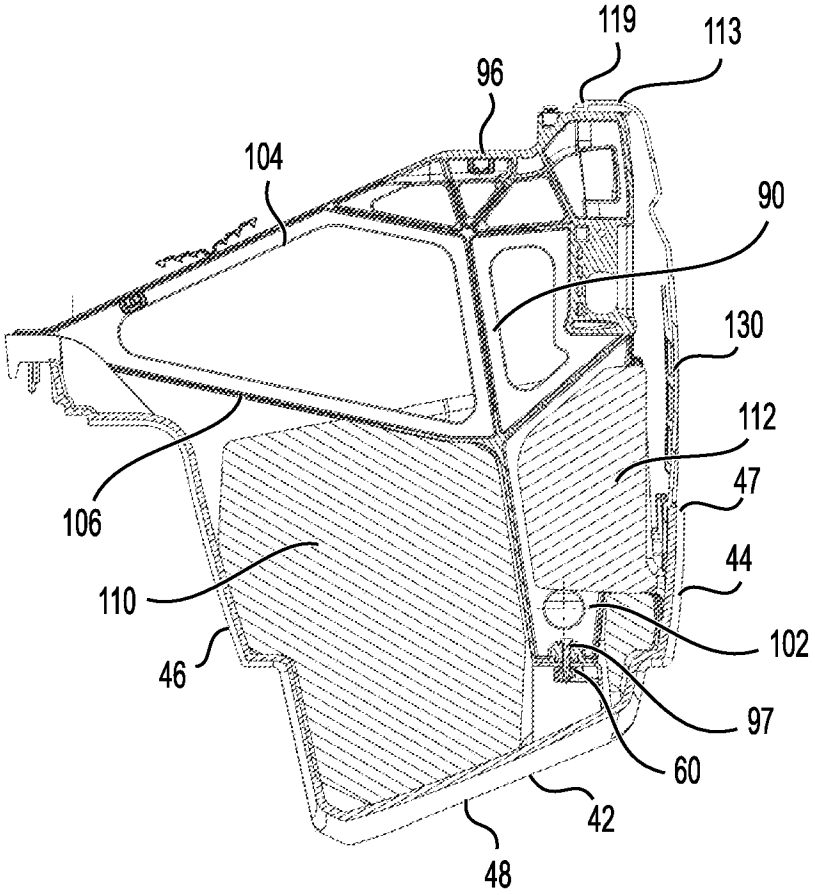
FIG. 18 is a cross-sectional view of the hull unit of FIG. 14 taken along line 18-18 in FIG. 17.

As shown in FIGS. 6, 7 and 13, in this embodiment, the lateral hull 40 also has three side panels 130 (one per lower hull panel 42) which extend on the outer lateral side of the lateral hull 40 between the lower hull panels 42 and the deck 20. In particular, as shown in FIG. 11, the side panels 130 extend from the outer lateral edge 47 of the lower hull panels 42 to the outer lateral edge 117 of the deck 20 (i.e., the outer lateral edges of the tiles 22). Each side panel 130 has four lower projections 135 extending from a lower edge thereof. The lower projections 135 are shaped like hooks and are configured for meshing with the projections 58 of the lower hull panels 42. Moreover, as can be seen in FIGS. 16 and 18, a channel 119 is defined at an upper end 113 of each side panel 130 for receiving a respective edge cover member 140 as will be described below.

Unlike the lower hull panels 42, the side panels 130 are not structural components and thus do not support significant loads.

Figure 26:
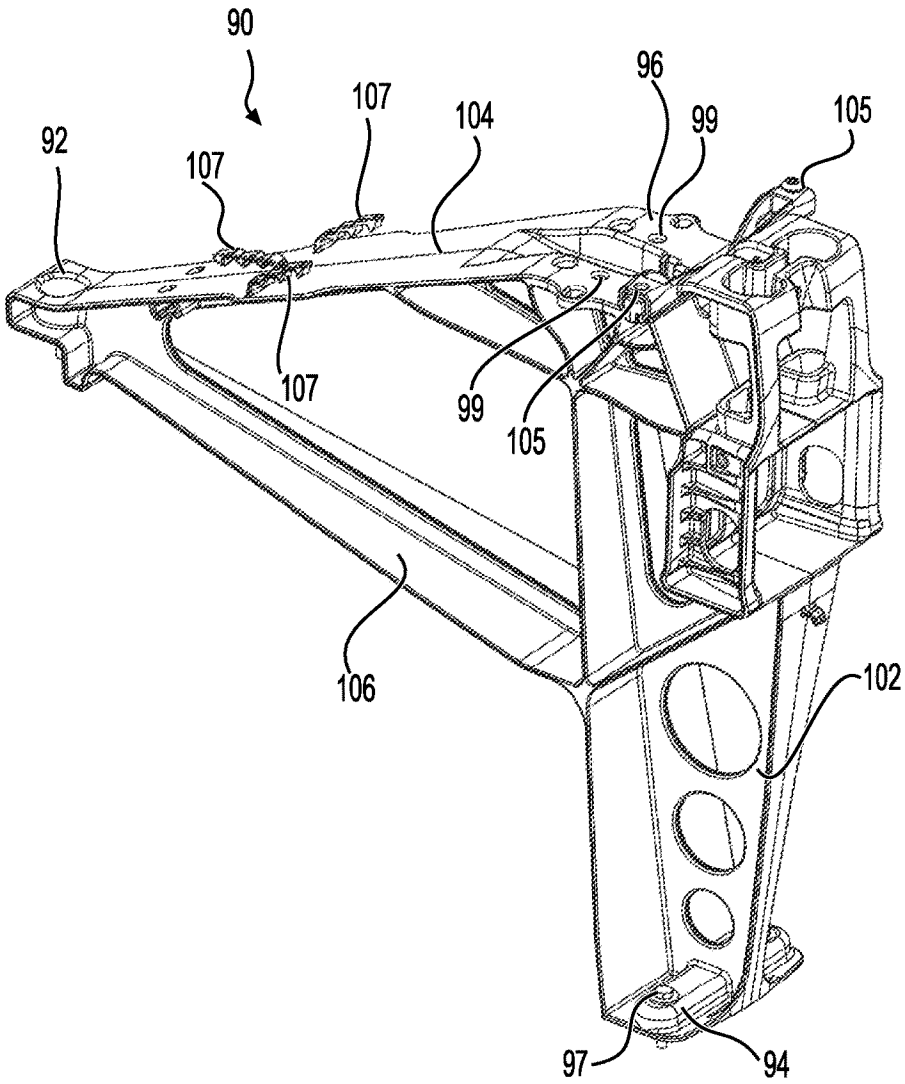
FIG. 26 is a perspective view, taken from a front left side, of the brace of FIG. 25.
Figure 27:
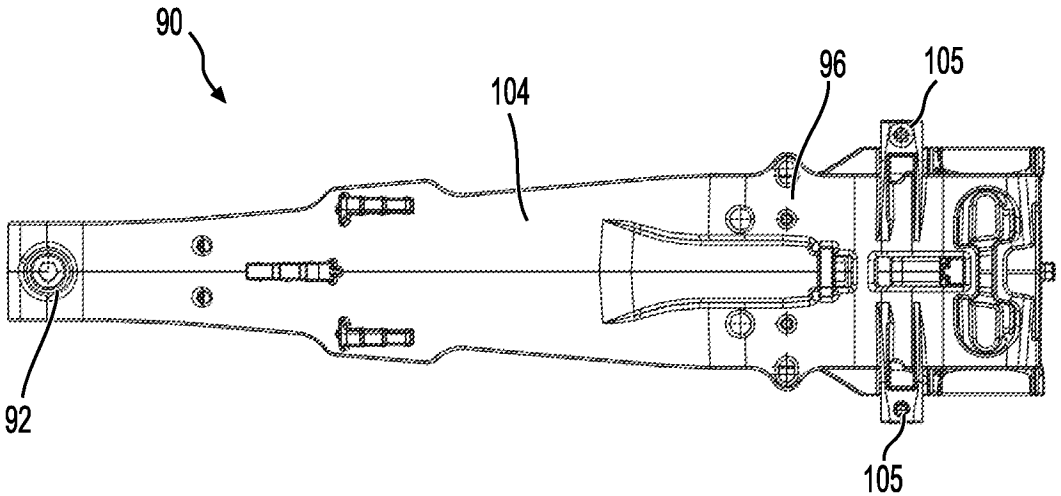
FIG. 27 is a top plan view of the brace of FIG. 25.
Figure 28:
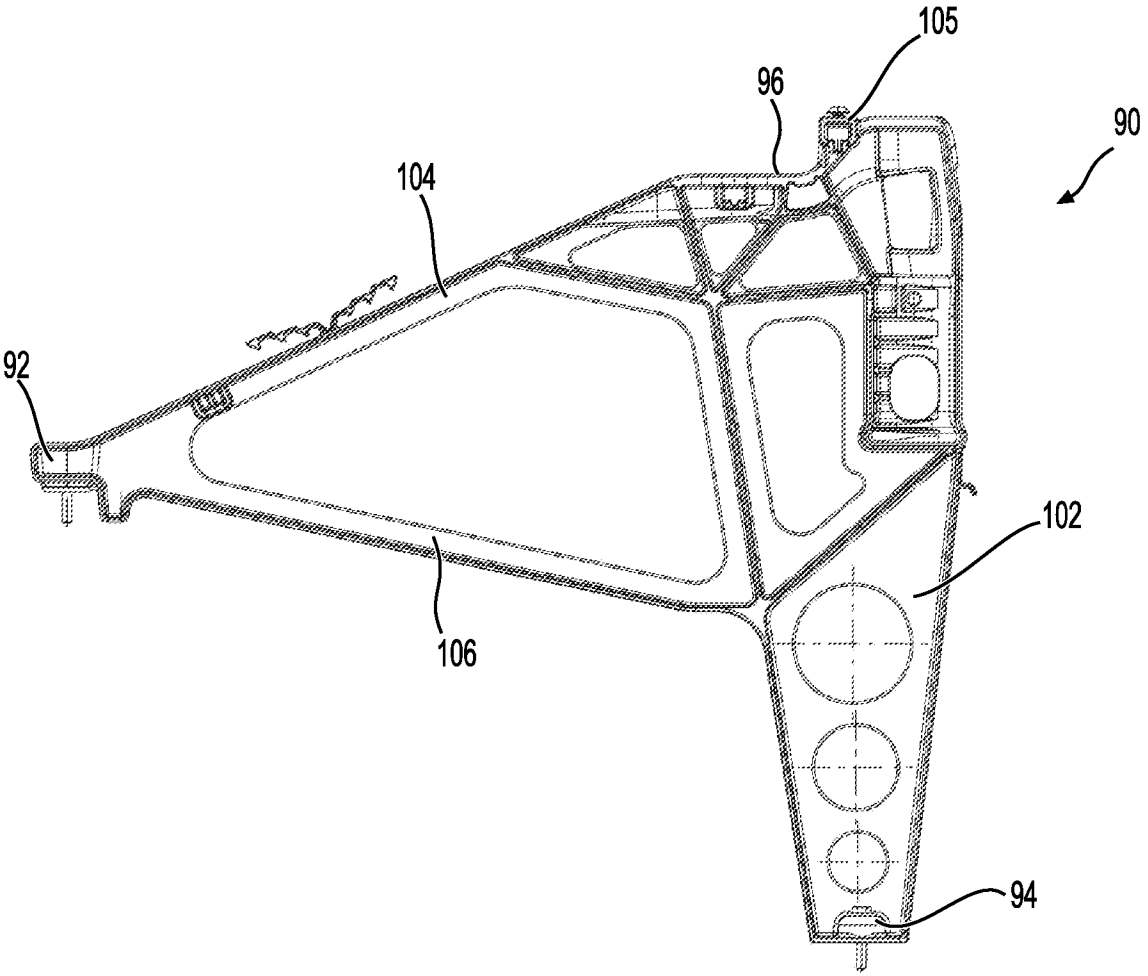
FIG. 28 is a front elevation view of the brace of FIG. 25.

As shown in FIG. 14, the lateral hull 40 also has a plurality of edge cover members 140 which cover part of the upper ends of the braces 90 and bridge the gap between the tiles 22 and the side panels 130. Each edge cover member 140 extends from the upper end 113 of a corresponding side panel 130 downwardly to the upper mount 96 of a corresponding brace 90. Notably, an outer lateral end of the cover member 140 engages the channel 119 formed at the upper end 113 of the side panel 130 and thereby retains the side panel 130. The inner lateral end of the cover member 140 abuts the outer lateral edges of the corresponding tiles 22. As shown in FIGS. 25 and 26, the upper end of each brace 90 has two cover member mounts 105 longitudinally spaced apart from one another. Each of the cover member mounts 105 defines an opening for receiving a corresponding fastener therein. The edge cover member 140 defines four openings 141 that are aligned with the openings defined by the cover member mounts 105 of three consecutive ones of the braces 90. A safety rail (not shown) may be attached to the braces 90 via the openings 141.

The lateral hull 40 also has a front side panel 132 which fills a gap on the outer lateral side of the lateral hull 40 between the front end cap 150 and the deck 20. In particular, as shown in FIGS. 6 and 7, the front side panel 132 extends from the outer lateral edge of the front end cap 150 to the outer lateral edge 117 of the deck 20 (i.e., the outer lateral edges of the tiles 22). The front side panel 132 also has lower projections 133 similar to the lower projections 135 of the side panels 130, which downwardly extend from a lower edge thereof. The lower projections 133 are shaped like hooks and are configured for meshing with respective projections (similar to the projections 58) of the front end cap 150. The upper end of the front side panel 132 is connected by a front one of the edge cover members 140 to the braces 90.

Contrary to conventional watercraft hulls, the lateral hull 40 is not sealed such that the interior thereof is in fluid communication with the exterior. As such, while the running surface 45 formed by the lower hull panels 42 is substantially continuous, water can flow into and out of the lateral hull 40, in particular when the boat 10 is at rest. Notably, the buoyancy of the lateral hull 40 is provided by the buoyant elements 110, 112 and therefore the flow of water into the lateral hull 40 is not problematic to the operation of the boat 10. This facilitates the manufacturing of the lateral hull 40 thus making it less expensive to produce, namely as the lower hull panels 42, the front end cap 150 and the rear end cap 152 can be made with significantly greater tolerances and the interfaces between the lower hull panels 42, as well as between the lower hull panels 42 and the front and rear end caps 150, 152 can forego being sealed. Furthermore, due to the manner in which the lower hull panels 42 overlap one another, with the front portion 89 of a rear one of two consecutive lower hull panels 42 being received between the lateral walls 44, 46 of the front one of the two consecutive lower hull panels 42, water will not be forced into the lateral hull 40 when the boat 10 moves forward.

Figure 17:
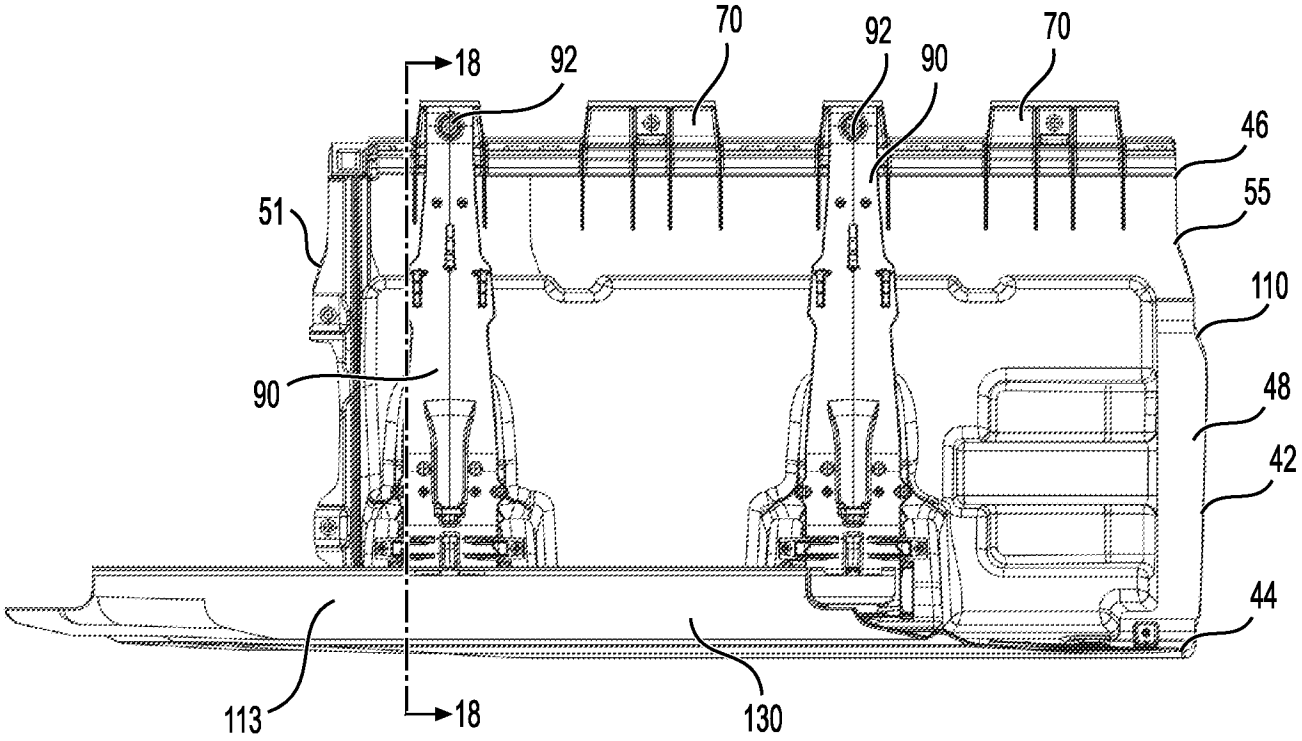
FIG. 17 is a top plan view of the hull unit of FIG. 14.
Figure 31:
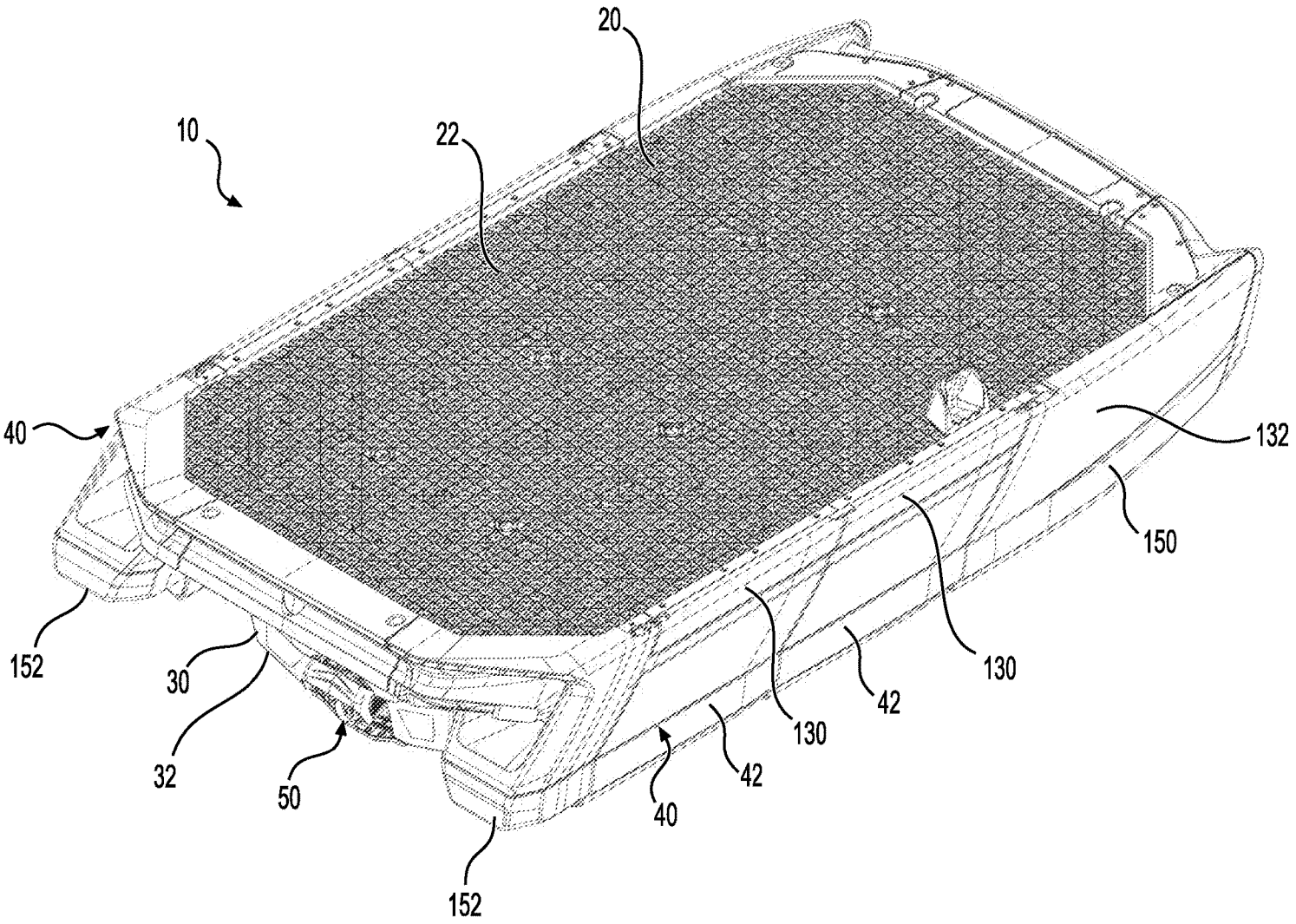
FIG. 31 is a perspective view, taken from a rear right side, of the pontoon boat of FIG. 1 in accordance with another embodiment in which the left and right hulls of the pontoon boat have fewer hull units.
Figure 32:
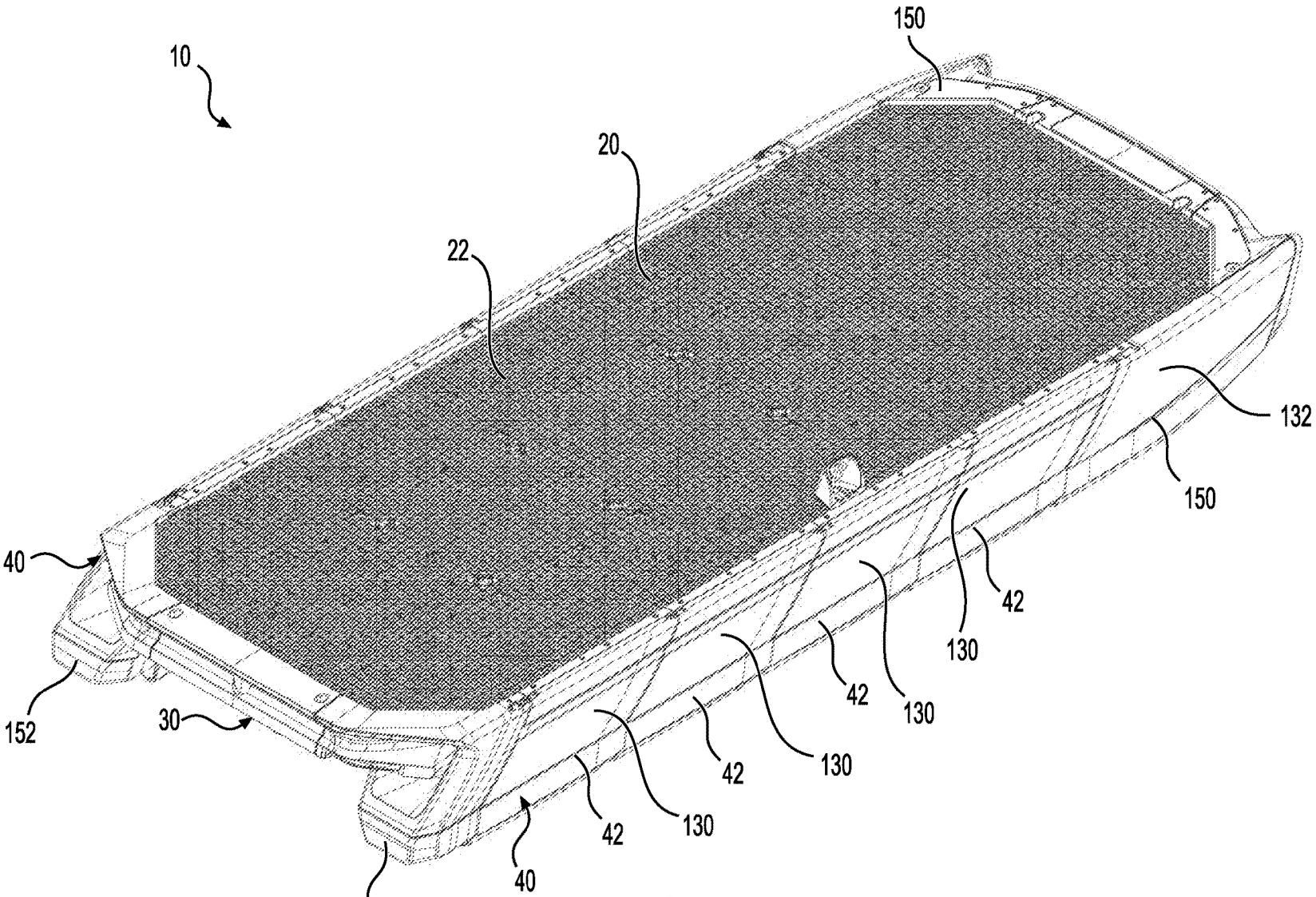
FIG. 32 is a perspective view, taken from a rear right side, of the pontoon boat of FIG. 1 in accordance with another embodiment in which the left and right hulls of the pontoon boat have more hull units.

As will be understood, the length of the lateral hull 40 can be varied by assembling the lateral hull 40 with more or fewer "hull units" (illustrated in FIGS. 16 and 17), each hull unit including a lower hull panel 42, a buoyant element 110, two buoyant elements 112, two braces 90 and a side panel 130. Notably, by including more hull units, the length of the lateral hull 40 is extended, while by including fewer hull units, the length of the lateral hull 40 is shortened. Thus, as mentioned above, different models of the boat 10 having different sizes can be easily produced with the above construction. Notably, in this embodiment, the boat 10 has three hull units while, as can be seen for example in FIGS. 31 and 32, alternative models of the boat 10 have left and right hulls 40 with two hull units (FIG. 31) and four hull units (FIG. 32).

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A watercraft, comprising:
- a central frame;
- a deck extending at least partially above and supported by the central frame;
- first and second lateral hulls laterally spaced apart from one another, the central frame being disposed at least in part laterally between the first and second lateral hulls, each of the first and second lateral hulls comprising:
  - a plurality of lower hull panels mounted to the central frame, at least part of an outer surface of each lower hull panel of the plurality of lower hull panels forming a running surface of the watercraft;
  - a plurality of braces connected between the central frame, the plurality of lower hull panels and the deck, each brace of the plurality of braces comprising:
    - an inner mount connected to the central frame;
    - a lower mount connected to at least one lower hull panel of the plurality of lower hull panels; and
    - an upper mount connected to the deck;
  - and
  - at least one buoyant element received in and substantially filling a space defined between the plurality of lower hull panels and the deck.

2. The watercraft of claim 1, wherein each of the first and second lateral hulls further comprises:
- a plurality of side panels extending between an outer lateral edge of at least one lower hull panel of the plurality of lower hull panels and an outer lateral edge of the deck.

3. The watercraft of claim 1, wherein the deck comprises a plurality of tiles, at least some of the plurality of tiles being connected along an inner edge thereof to the central frame and along an outer edge thereof to at least one brace of the plurality of braces.

4. The watercraft of claim 1, wherein the central frame comprises a central hull.

5. The watercraft of claim 4, wherein:
- the deck has an upper surface; and
- the watercraft further comprises a central hull cover connected to the central hull and having an upper surface that is contiguous with the upper surface of the deck.

6. The watercraft of claim 5, further comprising a power pack disposed at least partially between the central hull and the central hull cover.

7. The watercraft of claim 5, wherein each lower hull panel of the plurality of lower hull panels has an interlocking portion adjacent to an inner edge thereof for interlocking with a complementary portion of the central hull cover.

8. The watercraft of claim 1, wherein, for each of the first and second lateral hulls:
- each of the at least one buoyant element has an upper surface; and
- a gap is defined between the upper surface of each of the at least one buoyant element and the deck.

9. The watercraft of claim 8, wherein wiring extends through the gap defined between the upper surface of each of the at least one buoyant element and the deck.

10. The watercraft of claim 1, wherein each of the plurality of braces comprises a plurality of beam portions extending substantially linearly, including:

a first beam portion extending between the upper mount and the lower mount;

a second beam portion extending between the inner mount and the upper mount; and a third beam portion extending between the inner mount and the first beam portion.

11. The watercraft of claim 10, wherein the third beam portion extends between the inner mount and the lower mount.

12. The watercraft of claim 1, wherein, for each of the first and second lateral hulls:

the inner mount of each brace of the plurality of braces is positioned vertically between the upper mount and the lower mount thereof.

13. The watercraft of claim 1, wherein, for each of the first and second lateral hulls:

the inner mount of each brace of the plurality of braces is connected to the central frame; and a corresponding lower hull panel of the plurality of lower hull panels is mounted to the inner mount.

14. The watercraft of claim 1, wherein an interior of each of the first and second lateral hulls is in fluid communication with an exterior thereof such that water can flow into and out of the first and second lateral hulls.

15. The watercraft of claim 1, wherein, for each of the first and second lateral hulls, adjacent lower hull panels of the plurality of lower hull panels are fastened to one another via fasteners.

16. The watercraft of claim 1, wherein, for each of the first and second lateral hulls, consecutive lower hull panels of the plurality of lower hull panels are longitudinally adjacent to one another.

17. The watercraft of claim 16, wherein each of the first and second lateral hulls has a same number of lower hull panels such that a length of the first lateral hull is the same as a length of the second lateral hull.

18. The watercraft of claim 1, wherein, for each of the first and second lateral hulls:

the at least one buoyant element defines a plurality of recesses, each recess of the plurality of recesses being configured to receive in part a respective brace of the plurality of braces.

19. The watercraft of claim 1, wherein the at least one buoyant element is at least one foam block.

20. The watercraft of claim 1, wherein, for each of the first and second lateral hulls, the lower hull panels of the plurality of hull panels form a chine.

* * * * *